United States Patent [19]

Miyamoto et al.

[11] Patent Number: 4,591,884

[45] Date of Patent: May 27, 1986

[54] MULTI-FUNCTION IMAGE RECORDING APPARATUS

[75] Inventors: Koichi Miyamoto, Yokohama; Yuji Takahashi, Tokyo; Yutaka Kikuchi, Kawasaki, all of Japan

[73] Assignee: Canon Kabushiki Kaisha, Tokyo, Japan

[21] Appl. No.: 586,559

[22] Filed: Mar. 6, 1984

[30] Foreign Application Priority Data

| | | | |
|---|---|---|---|
| Mar. 10, 1983 | [JP] | Japan | 58-40202 |
| Mar. 19, 1983 | [JP] | Japan | 58-46701 |
| Jun. 1, 1983 | [JP] | Japan | 58-97165 |

[51] Int. Cl.[4] ..... G03G 15/00

[52] U.S. Cl. ..... 346/153.1; 355/14 SH

[58] Field of Search ..... 346/153.1, 150; 355/3 SH, 14 SH

[56] References Cited

U.S. PATENT DOCUMENTS

| | | | |
|---|---|---|---|
| 3,480,963 | 11/1969 | Stowell | 346/157 |
| 3,723,645 | 3/1973 | Takami et al. | 346/153.1 |
| 4,007,489 | 2/1977 | Helmberger et al. | 346/157 X |
| 4,419,007 | 12/1983 | Kingsley | 355/14 SH |

*Primary Examiner*—E. A. Goldberg
*Assistant Examiner*—A. Evans
*Attorney, Agent, or Firm*—Fitzpatrick, Cella, Harper & Scinto

[57] ABSTRACT

This specification discloses a multi-function image recording apparatus which is capable of selecting various functions such as high-speed recording, both-side recording and multiplex recording and recording images.

17 Claims, 30 Drawing Figures

MULTI-FUNCTION IMAGE RECORDING APPARATUS

BACKGROUND OF THE INVENTION

1. Field of the Invention

This invention relates to a multi-function image recording apparatus provided with various functions.

2. Description of the Prior Art

Various apparatuses for recording images on sheets have heretofore been put into practical use. For example, there are copying apparatuses of the type in which the images of originals are recorded on sheets through a photosensitive medium or the like, and printers in which image information transformed into an electrical signal is reproduced as an image on a sheet by an impact system (the type system, the wire dot system or the like) or a non-impact system (the thermosensitive system, the ink jet system, the laser beam system or the like).

In recent years, from the demand for rationalization of office work, high productivity has been required of these image recording apparatuses. Particularly, improvement of the output speed (the number of sheets treated per unit time) has been strongly desired and the tendency toward higher speeds has developed.

However, the respective systems have their own speed limits and if an attempt is made to provide higher speeds than them, numerous problems will occur and to overcome them, a great effort such as development of a new technique will be required and the apparatus itself will become complicated and bulky as well as uneconomical. Taking a copying apparatus as an example, the image of an original is directed to a photosensitive medium and imaged to form a latent image which is developed into a visible image which in turn is transferred to a sheet and therefore, only one copy can be obtained for one cycle of original scanning. Accordingly, to realize a higher copying speed, the mechanical speed must be increased and this in turn may lead to insufficient sensitivity of the photosensitive medium or occurrence of problems such as vibration of the machine, noise and problems of durability. In contrast, if a countermeasure such as increasing the quantity of light of the lamp for illuminating the original is adopted, numerous problems including the temperature rise of the machine due to the heat emitted by the lamp will occur and complete solution of these problems will be difficult. Moreover, this difficulty increases in the fashion of an exponential function as the speed increases and therefore, the upper limit speed is naturally restricted by the balance with the merits provided by higher speed.

On the other hand, it has heretofore usually been the practice to record images on one surface of sheets, but there is now the desire to record images on both surfaces of sheets as in ordinary printed matters and decrease the number of sheets used from the viewpoint of saving of resources or filing space. In this regard as well, a system whereby sheets having images recorded on a first surface thereof are once accumulated and after the recording on the first surface is completed, the accumulated sheets are again fed and images are recorded on a second surface thereof has been proposed and put into practical use. However, this system is efficient when many sheets having a record of the same content are to be prepared, but it is very inefficient when many sheets having different records on both surfaces thereof are to be prepared. That is, when pages 1, 2, 3, 4, . . . are to be prepared, odd pages, i.e., pages 1, 3, 5, . . . must first be recorded on the first surface of the respective sheets, and then these sheets must be fed again and pages 2, 4, 6, . . . must be recorded on the second surface of the respective sheets. If, during the second feeding, multiplex feeding or jam of sheets should occur, the combination of the front and back pages will become different from a predetermined one and thus, recording will have to be done over again from the beginning. To avoid this, recording may be effected on each sheet in such a manner that the front and back surfaces of each sheet provide the front and back pages, respectively, but this takes much time for the re-feeding of sheets and the efficiency is reduced. Also, in the prior art method, the conveyance route of sheets has been complicated and further, the conveyance route has unavoidably involved the step of reversing sheets, and this has led to extremely low reliability of sheet conveyance.

In the tendency toward higher productivity, there is further a desire to record two types of information on one surface of a sheet in superposed relationship. Particularly, recently, coloring has advanced in various fields and there is also a desire to mix, for example, red record with black record (for example, to record the title in red) instead of black record only in a document to thereby make the document easier to see. In the prior art apparatuses, this has been made possible by a system using an ink ribbon or the like, but in copying apparatuses using the electrophotographic method or laser beam printers, the apparatus itself becomes very large-scaled and therefore, apparatuses usable for ordinary office work have not yet been put into practical use. However, as a simple method, there is a system whereby recording is once effected in black, whereafter the developing device in the apparatus is changed from a black one to a red one and recording is again effected on the same surface, but this system has required much labor.

Also, where two types of information are to be recorded on one surface of the same sheet in superposed relationship, sufficient care must be taken of the image position accuracy, otherwise the resultant copy may become very unsightly due to color misregistration or deviation from a predetermined image recording frame. Furthermore, for example, when a transferred image is to be fixed on a sheet by a fixing system such as heat roller fixation, the heat or pressure imparted to the sheet accelerates deformation of the sheet and thus, great technical difficulties have been encountered as to the image position accuracy when two types of information are recorded on one surface of the sheet in superposed relationship.

SUMMARY OF THE INVENTION

It is therefore an object of the present invention to provide a novel multi-function image recording apparatus improved in view of the above-noted disadvantages.

It is another object of the present invention to provide a multi-function image recording apparatus in which a plurality of image forming portions are provided and organically connected together to enable high-speed recording, two-side recording and multiplex recording to be realized.

An essential construction of the present invention which can achieve the above objects comprises a multi-function image recording apparatus having a first image recording apparatus at least having a first supply path for supplying sheets, a first image forming portion for forming images on the sheets supplied from said path, and a first discharge path for discharging the sheets from said image forming portion, and a second image recording apparatus having a second supply path for supplying sheets, said record supply path being connected to said first discharge path, a second image forming portion for selectively forming images on a first surface or a second surface of the sheets supplied from said second supply path, and a second discharge path for discharging the sheets from said second image forming portion.

Another essential construction of the present invention which can achieve the above objects in a multi-function image recording apparatus having first and second image recording apparatuses each at least having a supply path for supplying sheets, an image forming portion for forming images on the sheets supplied from said path, and a discharge path for discharging the sheets from said image forming portion, first image fixing means for fixing the images recorded on the sheets by said first image recording apparatus, and path change-over means provided on a conveyance path for conveying the sheets having images formed thereon by said first image recording apparatus, said path change-over means selectively directing said sheets to one of said second image recording apparatus and said first image fixing means.

Still another essential construction of the present invention which can achieve the above objects comprises a multi-function image recording apparatus having first and second image recording apparatuses each at least having a supply path for supplying sheets, an image forming portion for forming images on the sheets supplied from said path, and a discharge path for discharging the sheets from said image forming portion, and a sheet handling device having a sheet carry-in path connected to the discharge path of said first image recording apparatus, a first sheet discharge path connected to the supply path of said second image recording apparatus, a second sheet carry-out path for discharging the sheets out of the apparatus, and a change-over guide for selectively directing the sheets carried in by said sheet carry-in path to said first sheet carry-out path or said second sheet carry-out path, the direction of the image output to said first image recording apparatus and the direction of the image output to said second image recording apparatus being freely selectable in one of the same direction and a direction turned by 180°.

As described above, according to a construction of the present invention, the sheet conveyance routes of a plurality of image recording apparatuses are organically connected together and therefore, various functions such as high-speed recording, two-side recording and multiplex recording can be performed at a high speed.

According to another construction of the present invention, a plurality of image recording apparatuses can select various routes to cause image fixing means to act selectively, whereby various functions such as high-speed recording, two-side recording and multiplex recording can be performed at a high speed and with good image position accuracy.

The invention will become more fully apparent from the following detailed description thereof taken in conjunction with the accompanying drawings.

DESCRIPTION OF THE PREFERRED EMBODIMENTS

Figure 1:
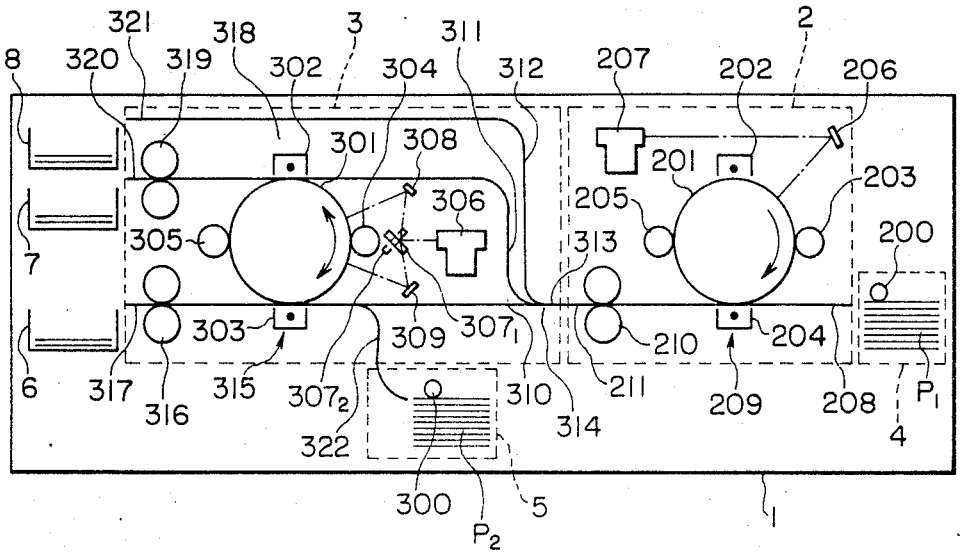
FIGS. 1 to 6 are cross-sectional views showing a first embodiment of the present invention.

Some specific embodiments of the present invention will hereinafter be described in detail by reference to the drawings. FIGS. 1 to 6 are cross-sectional views showing a first embodiment. Referring to FIG. 1 which depicts the basic construction of the present embodiment with the path of paper as the center, reference numeral 1 designates a main body, the interior of which is comprised of a first image recording portion 2, a second image recording portion 3, a first paper feeding portion 4, a second paper feeding portion 5, a first stacker portion 6, a second stacker portion 7 and a third stacker portion 8.

The first and second image recording portions 2 and 3 are laser beam printers. In the first image recording portion 2, reference numeral 201 denotes a rotatively driven photosensitive medium around which are disposed known electrophotographic process units such as a charger 202. a developing device 203, a transfer charger 204 and a cleaner 205. A laser beam modulated in accordance with an image signal is scanned on the photosensitive medium 201 by a laser scanner 207 through a mirror 206 to form a latent image thereon, which is made into a visible image by a predetermined electrophotographic process.

On the other hand, sheets of paper $P_1$ piled in the first paper feeding portion 4 are fed one by one into the paper supply path 208 of the first image recording portion 2 by feeding means 200 such as a known roller. The paper $P_1$ thus fed comes to a transfer station 209 in synchronism with the visible image on the photosensitive medium 201 and the visible image is transferred to the paper $P_1$ by the transfer charger 204. The paper $P_1$ then comes to a fixing station 210, in which the image on the paper is fixed by known means such as heating or pressing, and then the paper is discharged out of the first image recording portion 2 through a discharge path 211.

Figure 2:
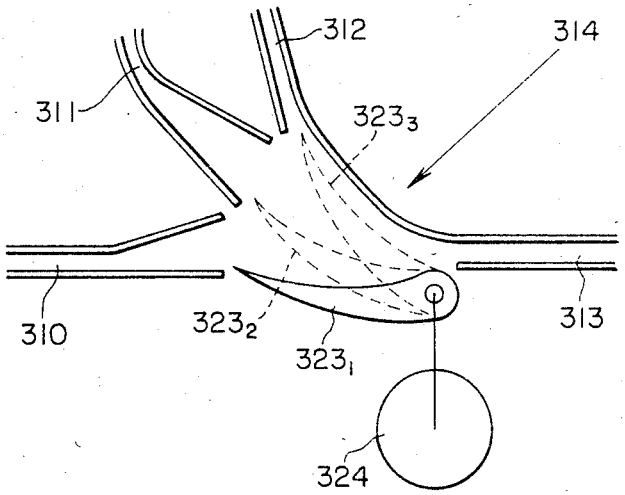

On the other hand, in the second image recording portion, reference numeral 301 designates a photosensitive medium which is selectively rotated clockwise or counter-clockwise. Disposed around the photosensitive medium 301 are chargers 302, 303, a developing device 304, a cleaner 305, etc. A laser beam modulated in accordance with an image signal is emitted from a laser scanner 306, is reflected by a mirror 307 selectively displaceable to a first position $307_1$ and a second position $307_2$ by a drive source, not shown, and a fixed mirror 308 or 309, and is scanned on the photosensitive medium 301 above or below the developing device 304. There are three paths for paper, i.e., a first paper path 310, a second paper path 311 and a third paper path 312, and paper received from a first supply path 313 connected to the discharge path 211 of the first image recording portion 2 may be selectively directed to one of the three paper paths by a path change-over portion 314. The first paper path 310 leads from the path change-over portion 314 via a first transfer station 315 and a first fixing station 316 to a first discharge path 317 and further to the first stacker portion 6. The second paper path 311 leads from the path change-over portion 314 via a second transfer station 318 and a second fixing station 319 to a second discharge path 320 and further to the second stacker portion 7. The third paper path 312 leads from the path change-over portion 314 via a third discharge path 321 to the third stacker portion 8. Also, sheets of paper $P_2$ piled in the second paper feeding portion 5 may be fed out one by one by feeding means 300 such as a known roller and directed to the first paper path 310 via a second supply path 322. FIG. 2 shows the details of the path change-over portion 314. In the branch-off portion of the first to third paper paths 310–312, a change-over pawl 323 is provided and may assume a first position $323_1$, a second position $323_2$ and a third position $323_3$ with the aid of drive means 324 such as a step motor 324. The paper directed to the supply path 313 can be directed to the first paper path 310 when the change-over pawl 323 is in the first position $323_1$, can be directed to the second paper path 311 when the change-over pawl 323 is in the second position $323_2$, and can be directed to the third paper path 312 when the change-over pawl 323 is in the third position $323_3$.

Conveyor means such as rollers and belts (not shown) are suitably disposed in the paths of paper.

How to cope with high-speed recording, two-side recording and multiplex recording in the apparatus as described above will hereinafter be described.

I. High-Speed Recording (FIG. 3)

Figure 3:
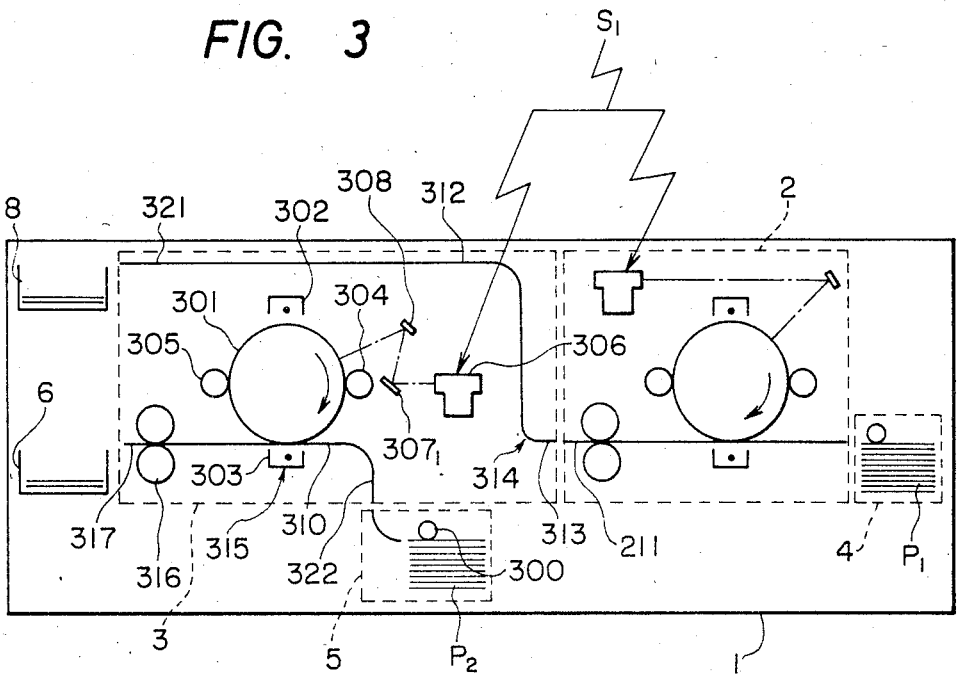

High-speed recording may be effected with an image signal $S_1$ provided to the present apparatus being distributed to the first and second image recording portions 2 and 3 and with the two image recording portions being operated in parallel (FIG. 3).

That is, the first image recording portion 2 receives the supply of paper $P_1$ from the first paper feeding portion 4, records the image by the signal $S_1$ on one side of the paper, and delivers the paper to the supply path 313 of the second image recording portion 3. In the second image recording portion 3, the change-over pawl 323 of the path change-over portion 314 is placed in the third position $323_3$, and the received sheets of paper $P_1$ are piled on the third stacker 8 via the third paper path 312 and the third discharge path 321.

On the other hand, the photosensitive medium 301 of the second image recording portion 3 is rotated clockwise in the case of high-speed recording and is first uniformly charged by the charger 302. The laser beam from the laser scanner 305 is reflected by the mirror 307 which is in the first position $307_1$ and the mirror 308 and is applied to the photosensitive medium 301 above the developing device 304, namely, upstream with respect to the direction of rotation of the photosensitive medium 301, whereby a latent image is formed on the photosensitive medium. The latent image is developed into a visible image by the developing device 304. On the other hand, one of the sheets of paper $P_2$ piled in the second paper feeding portion 5 is fed out by feeding means 501 and comes to the first transfer station 315 via the first paper path, and the visible image is transferred to the paper by the charger 303. Thereafter, the paper $P_2$ has the image thereon fixed by the first fixing station 316 and is discharged from the first discharge path into the first stacker portion.

By doing so, if the image recording capacities of the first and second image recording portions 2 and 3 per unit time are respectively N sheets, the image recording capacity of the entire apparatus per unit time is 2N sheets and thus, double high-speed recording can be realized.

II. Two-Side Recording (FIG. 4)

Figure 4:
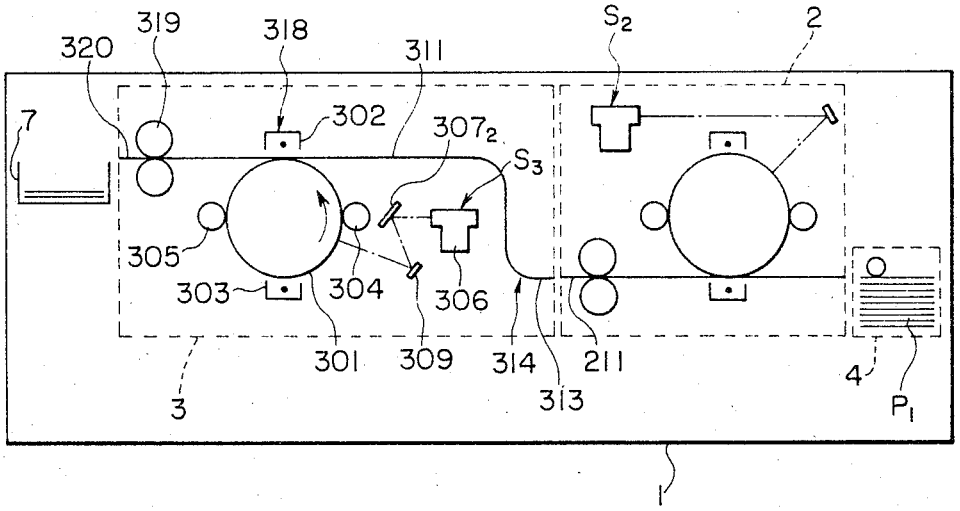

When it is desired to effect two-side recording, the apparatus is operated so that the recording by a given first surface image signal $S_2$ is effected on a first surface of paper by the first image recording portion 2 and the recording by a given second surface image signal $S_3$ is effected on a second surface of the paper by the second image recording portion 3 (FIG. 4).

That is, first, in the first image recording portion 2, the supply of paper $P_1$ from the first paper feeding portion 4 is received, and then the image by the first surface signal $S_2$ is recorded on the first surface (the upper surface in the Figure) of the paper $P_1$, whereafter the paper $P_1$ is delivered to the supply path 313 of the second image recording portion 3.

In the second image recording portion 3, the change-over pawl 323 of the path change-over portion 314 is placed in the second position $323_2$ and directs the received paper $P_1$ to the second paper path 311.

On the other hand, the photosensitive medium 301 is rotated counter-clockwise was viewed in FIG. 4 in the case of two-side recording, and is first uniformly charged by the charger 303. The laser beam from the laser scanner 306 is reflected by the mirror 307 changed to the second position $307_2$ and the mirror 309 and is applied to the photosensitive medium 301 below the developing device 304, namely, upstream with respect to the direction of rotation of the photosensitive medium 301, whereby a latent image is formed on the photosensitive medium. The latent image is developed into a visible image by the developing device 304.

The paper $P_1$ directed to the second paper path 311 comes to the second transfer station 318 in synchronism with the visible image on the photosensitive medium 301, and the visible image is transferred to the paper $P_1$ by the charger 302. This image transfer is effected onto the lower surface of the paper $P_1$, namely, the second surface of the paper which is opposite to that surface of the paper onto which the image transfer in the first image recording portion 2 has been effected. Thereafter, the paper $P_1$ has the image on its second surface fixed by the second fixing station 319 and is discharged from the second discharge path 320 into the second stacker portion 7, thus completing the two-side recording.

In the meantime, the second paper feeding portion 5 remains inoperative.

III. Multiplex Recording (FIG. 5)

Figure 5:
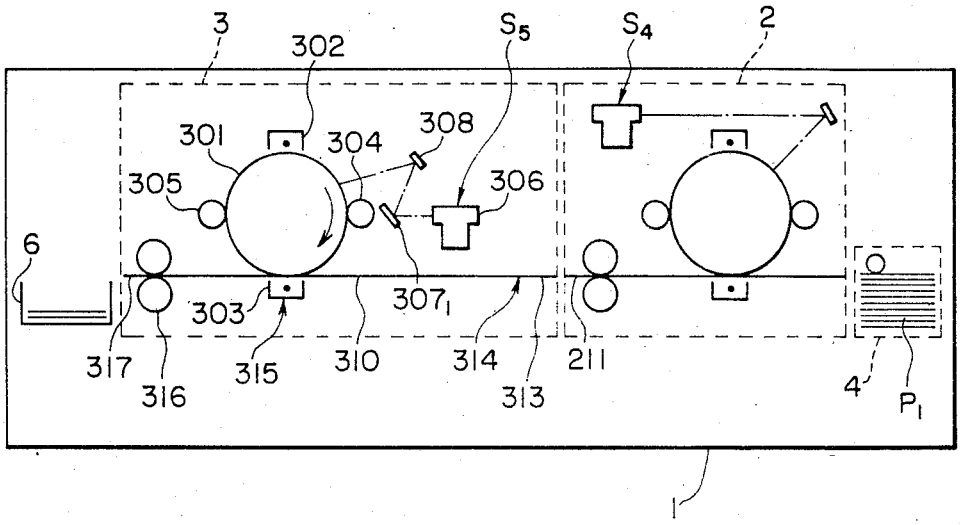

When multiplex recording is to be effected, the recording by a given first image signal $S_4$ is effected on a surface of paper by the first image recording portion 2 and the recording by a given second image signal $S_5$ is effected on the same surface of the paper by the second image recording portion 3 (FIG. 5).

That is, first, in the first image recording portion 2, the supply of paper $P_1$ from the first paper feeding portion 4 is received, and the first image by the signal $S_4$ is recorded on one surface (the upper surface in the Figure) of the paper $P_1$, which is then delivered to the supply path 313 of the second image recording portion 3.

In the second image recording portion 3, the change-over pawl 323 of the path change-over portion 314 is placed in the first position $323_1$ and directs the received paper $P_1$ to the first paper path 310.

On the other hand, the photosensitive medium 301 is rotated clockwise as viewed in FIG. 5 in the case of multiplex recording and is first uniformly charged by the charger 302. The laser beam from the laser scanner 306 is reflected by the mirror 307 which is in the first position $307_1$ and the mirror 308, and is applied to the photosensitive medium 301 above the developing device 304, namely, upstream with respect to the direction of rotation of the photosensitive medium 301, whereby a latent image is formed on the photosensitive medium. The latent image is developed into a visible image by the developing device 304.

The paper $P_1$ directed to the first paper path 310 comes to the first transfer station 315 in synchronism with the visible image on the photosensitive medium 301 and the visible image is transferred to the paper $P_1$ by the charger 303. This image transfer is effected onto the upper surface of the paper $P_1$, that is, the same surface as that surface on which the image transfer in the first image recording portion 2 has been effected. Thereafter, the paper $P_1$ has the image thereon fixed by the first fixing station 316 and is discharged from the first discharge path 317 into the first stacker portion 6, thus completing the multiplex recording.

In the meantime, the second paper feeding portion 5 remains inoperative.

How to cope with three high productivity functions has been described above and, in addition, in the apparatus of the present embodiment, the two image recording portions 2 and 3 can be independently operated as two recording apparatuses by signals $S_6$ and $S_7$ of independent contents and timings.

Figure 6:
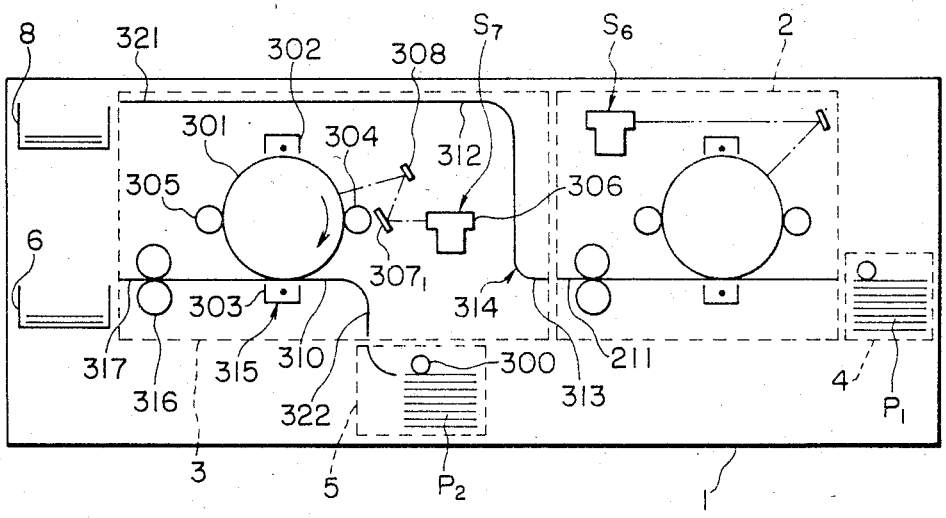

IV. Independent Recording (FIG. 6)

The operation of each portion of the apparatus in this case is substantially similar to that in the case of high-speed recording with the only exception being that signals $S_6$ and $S_7$ are imparted to the first image recording portion 2 and the second image recording portion 3, respectively, to thereby effect recording on paper $P_1$ and paper $P_2$, respectively and that the operations of the two image recording portions 2 and 3 are entirely non-synchronous (for example, the first image recording portion 2 only operates and the second image recording portion 3 is put out of service).

If this is done, the single apparatus of the present embodiment can perform entirely the same function as two image recording apparatuses each having a image recording capacity of N sheets per unit time.

In the present embodiment, the paper $P_2$ from the second paper feeding portion 5 is directed to the first paper path 310 and the image is transferred to the upper surface of the paper $P_2$ as viewed in the Figure, whereas this is not restrictive, but the paper $P_2$ may be directed to the second paper path 311 and the image may be transferred to the lower surface of the paper $P_2$ as viewed in the Figure. In this case, it is apparent that when high-speed recording and independent recording are effected, various functions including the direction of rotation of the photosensitive medium 301 of the second image recording portion 3 may be performed in the same manner as that during two-side recording.

Also, in the present embodiment, the various process units are used in common in accordance with the forward or reverse direction of rotation of the photosensitive medium 301 to effect a predetermined process, whereas this is not restrictive but independent process units for forward rotation and reverse rotation, respectively, may be disposed around the photosensitive medium 301.

Figure 7:
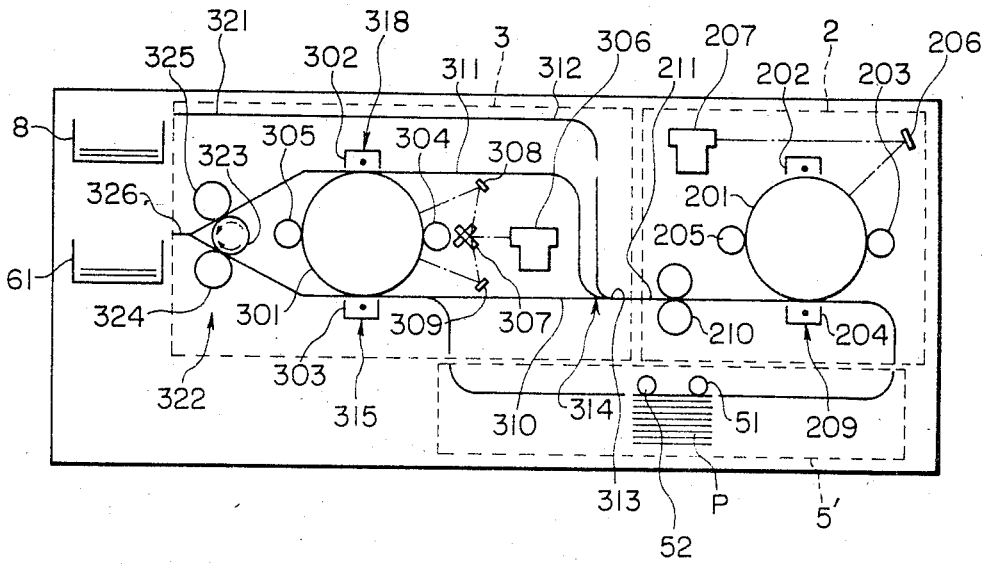
FIGS. 7 and 8 are cross-sectional views showing further embodiments.

Another embodiment of the present invention will now be described by reference to FIG. 7. In FIG. 7, portions and members entirely identical in function to those in the first embodiment are given identical reference numerals and need not be described.

The present embodiment intends to use a single portion in common for functionally overlapping portions in the first embodiment, namely, the paper feeding portions, the fixing stations of the second image forming portion 3 and the stacker portions.

As regards the paper feeding portions, durinq high-speed recording, both of the first and second paper feeding portions 4 and 5 are operating, but during two-side recording and multiplex recording, the second paper feeding portion 5 is put out of service. Accordingly, a single paper feeding portion will do if it has the capability of supplying paper to both of the image recording portions 2 and 3 during high-speed recording. In that case, only one paper supply station will be required and this enhances convenient operation.

Also, the first and second fixing stations 316 and 319 of the second image recording portion 3 are never used at one time, but one of then is always put out of service.

Likewise, the first and second stacker portions 6 and 7 are never used at one time.

Accordingly, if a single one is used in common for these portions, respectively, it will be economical and enable the apparatus to be compact.

Thus, in the present embodiment, only one paper feeding portion 5' for supplying paper to the first and second image recording portions 2 and 3 is provided to facilitate the supply of paper P.

That is, sheets of paper P are piled at one place, and paper feeding means 51 for feeding paper toward the first image recording portion 2 and paper feeding means 52 for feeding paper toward the second image recording portion 3 are disposed at the uppermost part of the pile of paper sheets. These paper feeding means 51 and 52 are operable in response to a signal, and when one of them is operated to feed the paper P, the other does not hamper it (for example, where the paper feeding means are rollers, the other roller rotates freely).

When paper is to be fed toward the first image recording portion 2, the paper feeding means 51 is operated to feed the uppermost paper sheet P to the right as viewed in FIG. 7. Also, when paper is to be fed toward the second image recording portion 3, the paper feeding means 52 is operated to feed the uppermost paper sheet P to the left as viewed in FIG. 7. When paper sheets P must be fed to both image recording portions 2 and 3 substantially at a time, one of the paper feeding means 51 and 52 is first operated to feed a sheet of paper to the right or to the left. If the other paper feeding means is operated after the trailing end edge of that paper sheet has passed just beneath the other paper feeding means 52 or 51, the second sheet of paper will be fed in the direction opposite to the first sheet of paper. In this manner, feeding of the second sheet can be started before the preceding sheet has left the pile of paper sheets (i.e., immediately after feeding of the first sheet has been started) and therefore, the single paper feeding portion 5' will do sufficiently even if the two image recording portions 2 and 3 effect continuous recording with the paper feeding interval being considerably reduced. In the present embodiment, two paper feeding means 51 and 52 are provided, but a single paper feeding means operable to the right and left would also attain the same effect.

Next, the paper directed along the first paper path 310 and the paper directed along the second paper path 311 are fixed by a common fixing device 322. The fixing device 322 comprises a fixing roller 323 having its surface subjected to offset preventing treatment and two back-up rollers 324, 325. When paper P is advancing along the first paper path 310 during high-speed recording or multiplex recording, the fixing roller 323 is rotated clockwise as viewed in FIG. 7 to cause the paper P to pass between the fixing roller 323 and the back-up roller 324, thereby accomplishing the fixation. Also, when paper P is advancing along the second paper path 311 during both-side recording, the fixing roller 323 is rotated counter-clockwise as viewed in FIG. 7 to cause the paper P to pass between the fixing roller 323 and the back-up roller 325, thereby accomplishing the fixation.

After completion of the fixation, the paper is directed to a common discharge path 326, and then is discharged into a common stacker portion 61.

The construction as described above will lead to the result that the paper feeding portion, the fixing station and the stacker portion are operated without waste in case of any type of recording.

The stacker portions 61 and 8 can be replaced by a common stacker portion. In that case, it never happens that the same records are piled at two separate places particularly during high-speed recording, and this is convenient in operation.

Figure 8:
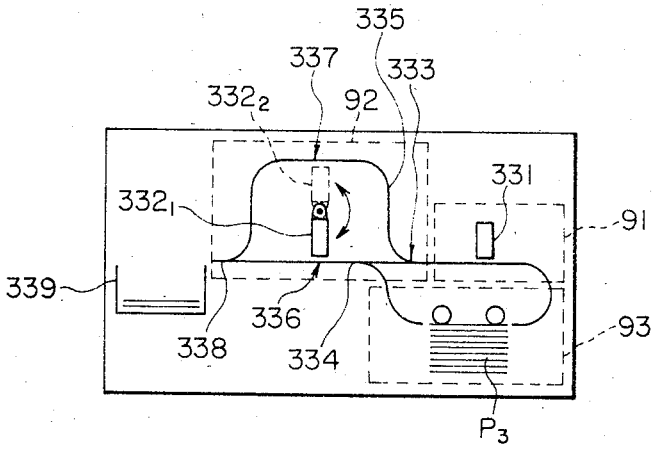

FIG. 8 shows still another embodiment of the present invention in which both of the first and second image recording portions are ink jet printers.

Reference numerals 331 and 332 designate ink jet heads provided in the recording portions 91 and 92, respectively, and adapted to discharge ink droplets toward paper in response to a given image signal. Sheets of paper $P_3$ are piled in the paper feeding portion 93 and may be fed toward the recording portions 91 and 92 in the same manner as that described in connection with the previous embodiment. The paper $P_3$ fed toward the head 331 is subjected to image recording by the head 331 and fed to the recording portion 92. In the recording portion 92, the paper is selectively directed to a first path 334 or a second path 335 by a change-over portion 333.

The head 332 is displaceably supported and may assume a first position $332_1$ opposed to a first recording position 336 on the first path 334 and a second position $332_2$ opposed to a second recording position 337 on the second path 335 with the aid of drive means, not shown. The first and second paths 334 and 335 join each other via the recording positions 336 and 337 and are connected to a discharge path 338 and further to a stacker portion 339.

The head 332 assumes the first position $332_1$ during high-speed recording, multiplex recording and independent recording, and assumes the second position $332_2$ during both-side recording.

The path of paper during the various types of recording is substantially similar to that in the previously described embodiments and therefore need not be described in detail. The only difference in the path of paper between the present embodiment and the previously described embodiments is that in the previously described embodiments, the second paper path 311 and the third paper path 312 are independent of each other, whereas in the present embodiment, a second path 335 is used in common. That is, during high-speed recording and independent recording, the paper recorded in the first recording portion 91 passes along the second path 335 in the second recording portion. In the previously described embodiments, the second paper path 311 is in contact with the moving photosensitive medium 301 or the fixing station 319 which is unnecessary during high-speed recording and independent recording is present and therefore, paper cannot be caused to pass along this path. However, the present embodiment is of the ink jet type and therefore, in the present embodiment, even if the paper recorded only in the first recording portion 91 passes through the second recording position $332_2$, no harm results. A fixing station like that in the electrophotographic system is absent and thus, a path which corresponds to the third paper path 312 has become unnecessary.

Figure 9:
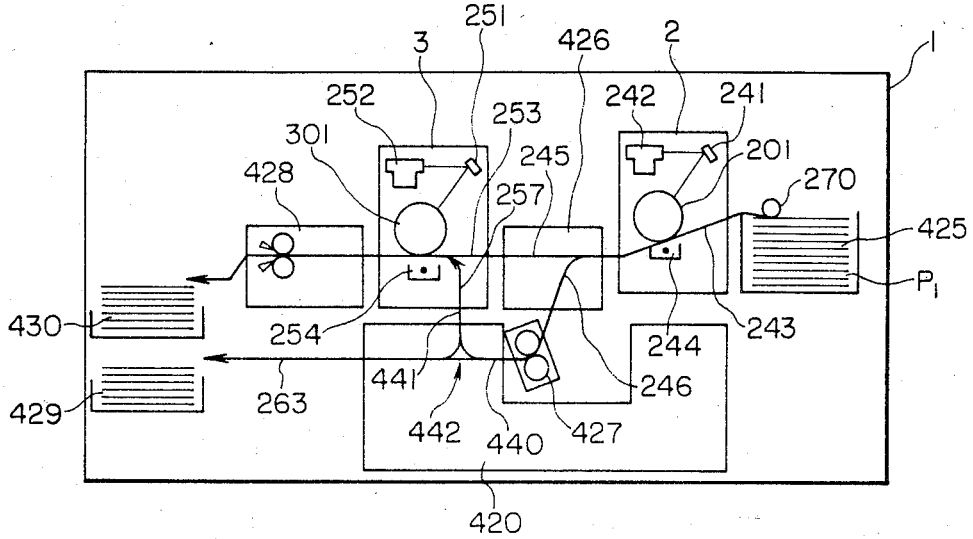
FIG. 9 is a cross-sectional view of a second embodiment of the present invention.

The second embodiment of the present invention will now be described in detail by reference to the drawings. Referring to FIG. 9 which depicts the basic construction of the second embodiment of the present invention with the path of paper as the center, reference numeral 1 designates a main body, the interior of which is comprised of first image forming means 2, second image forming means 3, a paper handling portion 420, a first paper supplying portion 425, path change-over means 426, first image fixing means 427, second image fixing means 428, a first stacker 429 and a second stacker 430.

The first and second image recording portions 2 and 3 are laser beam printers substantially similar in construction to each other. Describing the first image recording portion 2, reference numeral 201 designates a rotatively driven photosensitive medium around which are disposed known electrophotographic process units (not shown). A laser beam modulated in accordance with an image signal is scanned on the photosensitive medium 201 by a laser scanner 242 through a mirror 241 to thereby form a latent image on the photosensitive medium, and then the latent image is made into a visible image by a predetermined electrophotographic process. On the other hand, sheets of paper $P_1$ piled in the first paper feeding portion 425 are fed one by one into the paper supply path 243 of the first image recording portion 2 by paper feeding means 270 such as a known roller. The fed paper comes to a transfer station 244 in synchronism with the visible image on the photosensitive medium 201, and the visible image is transferred to the paper by known transfer means. The paper is then directed to the path change-over means 426. The path change-over means 426 changes over paper conveyance paths 245 and 246 to thereby direct the transfer paper selectively to the second image forming means 3 or the first image fixing means 427. If the paper is directed to the second image forming means 3, image is formed on the paper by the second image forming means 3 as has been done by the first image forming means 2, and the images formed by the first and second image forming means 2 and 3 are fixed by the second image fixing means 428, whereafter the paper is discharged into the second stacker 430. On the other hand, if the paper is directed to the first image fixing means 427 by the path change-over means 426, image fixation is effected by the first image fixing means 427, and then the paper is directed to the paper handling portion 420.

The difference of the second image recording portion 3 is that in addition to the paper supply path 253 connected to the transfer paper conveyance path 445 via the path change-over means 426 and directing the unfixed image bearing paper of the first image forming means, there is provided a second paper supply path 257 for receiving paper from the paper handling portion 420. The paper sheets received from the two paper supply paths are both directed to the transfer station 254. As in the first image forming means 2, a laser beam modulated in accordance with an image signal is scanned on a photosensitive medium 301 by a laser scanner 252 through a mirror 251 to thereby form a latent image on the photosensitive medium, and then the latent image is made into a visible image by a predetermined electrophotographic process. The paper handling portion 420 reverses the paper received from a carry-in path 440 or does not reverse the paper but delivers the paper to the second image forming means 3 by a conveyance path 441 or delivers the paper from a discharge path 263 to the first stacker 429 via a paper reversing portion 442. The conveyance path 441 is connected to the second paper supply path 257 and adapted to direct paper before the transfer station 254 of the second image forming means 3.

Figure 10:
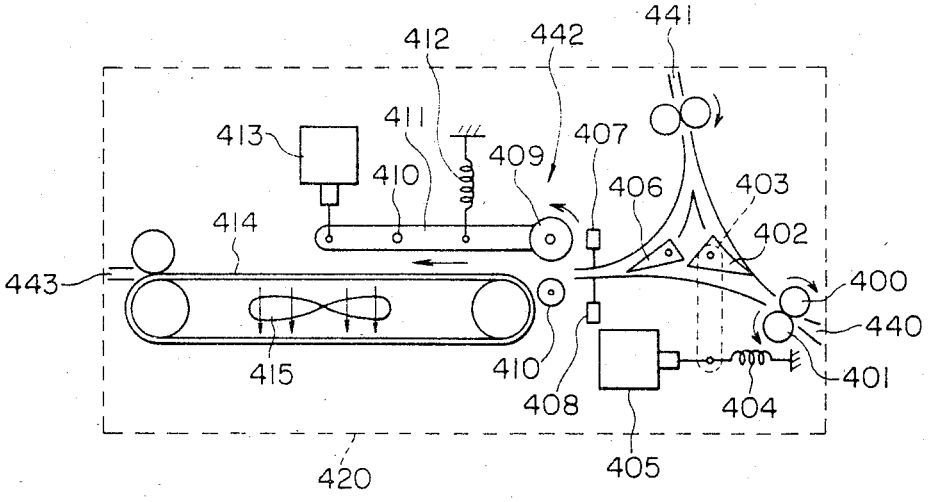
FIG. 10 is an enlarged cross-sectional view of a reversing portion.

The details of the interior are shown in FIG. 10. Rollers 400 and 401 in the paper carry-in path 440 are rotated in the directions of arrows, and a path change-over pawl 402 is disposed ahead of the rollers. The path change-over pawl 402 is pivotable about a shaft 403 and normally biased counter-clockwise as viewed in FIG. 10 by a spring 404 to thereby cause the paper path to face the paper reversing portion 442. Now, if a solenoid 405 is operated, the path change-over pawl 402 rotates clockwise against the force of the spring 404 to change over the path to the carry-out path 441 side. A pawl 406 depending from gravity is provided at the entrance of the paper reversing portion 442, and the paper fed to the left as viewed in FIG. 10 from the carry-in path 440 can pass by pushing aside the lower surface of the pawl 406, and the paper having returned to the right as viewed in FIG. 10 from the paper reversing portion 442 is guided by the upper surface of the pawl 406 and travels toward the carry-out path 441. A paper detector comprising a lamp 407 and a light-receiving element 408 is provided adjacent to the pawl 406. Reference numerals 409 and 410 designate a reversing roller and a follower roller, respectively. The reversing roller 409 is mounted on the end of an arm 411 pivotable about a shaft 410, and is normally rotated counter-clockwise as viewed in FIG. 10. The arm 411 is suspended by a spring 412 and the reversing roller 409 normally has an interval with respect to the follower roller 410, but when a solenoid 413 is operated, the arm 411 pivots clockwise and the reversing roller 409 is urged against the follower roller 410. The follower roller 410 is rotatably supported and will rotate clockwise if the reversing roller 409 is urged thereagainst. A belt 414 movable in the direction of the arrow is provided on the follower roller and paper may be attracted to the belt 414 by a fan 415 therebelow and directed to the carry-out path 443.

Operation of the paper handling portion 420 will now be described. First, when paper is to be directed from the carry-in path 440 directly to the conveyance path 441, if the solenoid 405 is operated, the path change-over pawl 402 changes over so that the path from the carry-in path 440 to the conveyance path 441 is formed.

Also, when paper is to be directed to the conveyance path 441 after it has been reversed, the solenoid 405 is not operated and the paper is directed to the paper reversing portion 442. When the leading end edge portion of the paper passes between the reversing roller 409 and the follower roller 410 and rides onto the belt 414, the paper is fed to the left by the suction force of the fan 415. When the passage of the trailing end edge of the paper is detected by the lamp 407 and the light-receiving element 408, the solenoid 413 is operated and the reversing roller 409 is urged against the follower roller 410 to thereby nip the paper therebetween. At this time, the reversing roller 409 is rotating counter-clockwise and therefore, the paper overcomes the friction force with the belt 414 caused by the fan 415 and is fed to the right as viewed in FIG. 10. That is, the paper advances with the end edge thereof which has so far been the trailing end edge of the paper now being the leading end edge. When the new leading end edge of the paper arrives at the pawl 406, as previously mentioned, the pawl 406 provides a guide and the paper is directed to the carry-out path 441. Comparing this time with the time when the paper was channeled directed to the carry-out path 441, the paper is turned upside down.

On the other hand, when paper is to be directed to the discharge path 443, the solenoid 405 is rendered inoperative and the paper is directed to the paper reversing portion 442, and if the solenoid 413 is then left inoperative, the paper is fed to the left by the cooperation between the belt 414 and the fan 415 and is directed intact to the discharge path 443. The first and second stacker portions 429 and 430 are for successively piling the paper sheets discharged from the discharge path 443 of the paper handling portion 420 and the second image fixing means 428, respectively.

FIGS. 11, 12, 14 and 15 show the actual image recording procedures in the apparatus as shown in FIG. 9.

Figure 11:
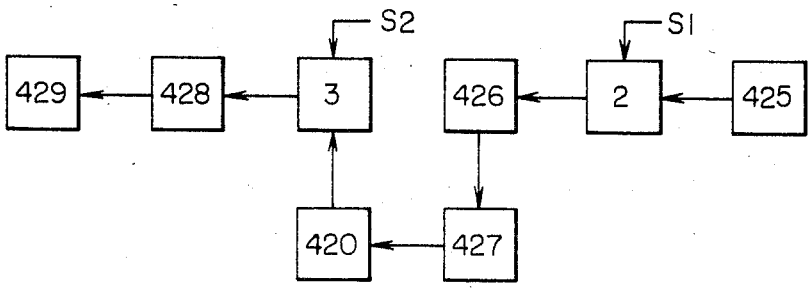
FIGS. 11 and 12 are block diagrams of the second embodiment.

FIG. 11 is a flow chart of when two-side recording is effected. When two-side recording is to be effected, the recording by a first surface image signal S1 imparted to a first surface of paper is effected on the paper fed from the first paper supplying portion 425, by the first image forming means 2 and the paper is delivered to the path change-over means 426. The paper is directed to the first image fixing means 427 by the path change-over means 426, and the paper subjected to image fixation by the first image fixing means 427 is delivered to the paper handling portion 420. In the paper handling portion 420, the aforementioned paper reversing operation is carried out. That is, the solenoid 405 is rendered inoperative and the paper $P_1$ is fed into the paper reversing portion 442, and then the paper detector 407, 408 detects the trailing end edge of the paper to thereby operate the solenoid 413, and the paper $P_1$ is directed to the conveyance path 441 with the so far trailing end edge thereof as the leading end edge and is delivered to the second image recording means 3. Image recording is effected by the second image recording means 3 on that surface of the thus delivered paper $P_1$ which is opposite to the surface on which image recording has been effected by the first image recording means 2. The paper $P_1$ having images recorded on its both surfaces is directed to the second image fixing means 428, whereby the images on the paper $P_1$ are fixed, and then the paper $P_1$ is discharged into the first stacker portion 429, thus completing, two-side recording.

Figure 12:
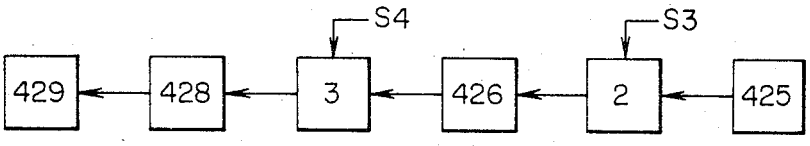

FIG. 12 is a flow chart of when multiplex recording is effected. When multiplex recording is to be effected, the recording by a first surface image signal S3 imparted to a first surface of paper is effected on the paper fed from the first paper supplying portion 425, by the first image recording portion 2, and the paper is delivered to the path change-over means 426. The paper is directed to the second image recording portion 3 by the path change-over means 426 without being subjected to image fixation, and by the second image recording portion 3, a second image by an image signal S4 is formed on the same surface as the surface of the paper on which the first image has been formed by the first image recording portion 2. In this case, when the image recording colors of the first and second image recording portions 2 and 3 differ from each other, the formed images will be multi-colored. The paper $P_1$ on which images have been multiplexly formed by the second image recording portion 3 is subjected to image fixation by the second image fixing means 428 for the first time, and then is discharged into the second stacker 430, thus completing multiplex recording.

When repetitive image formation on the same surface, i.e., multiplex image formation, is effected in this manner, deformation which would otherwise be caused by pressure, heat, etc. applied to the paper can be prevented by the paper being not passed through the fixing means between the individual image formations and thus, the registration accuracy and positional accuracy of the images can be improved.

Two-side recording and multiplex (multicolor) recording have been described above on the basis of the construction of FIG. 9, and higher speed of the double speed mode can be realized by having two or more image forming means and thereby causing the respective image forming means to form the same image independently of each other.

Figure 13:
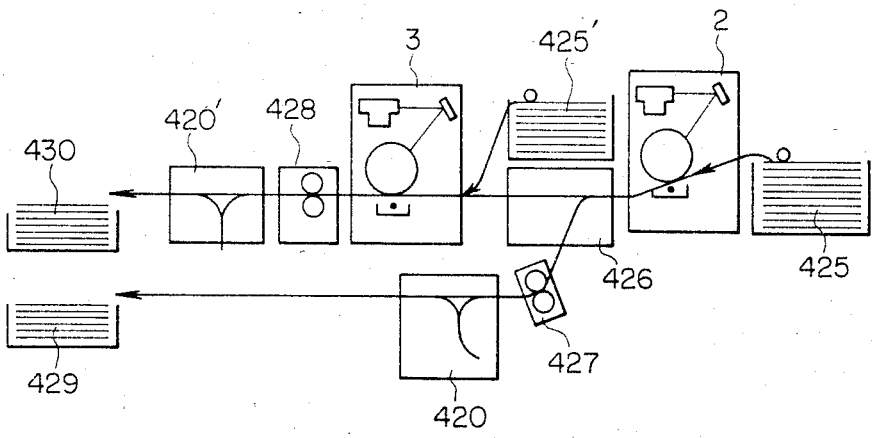
FIG. 13 is a cross-sectional view of an embodiment of the double speed mode.

FIG. 13 shows an embodiment in which a second paper supplying portion 425' for supplying paper also to the second image recording portion 3 is provided in addition to the construction of FIG. 9 so as to be able to cope with the higher speed of the double speed mode as well.

Figure 14:
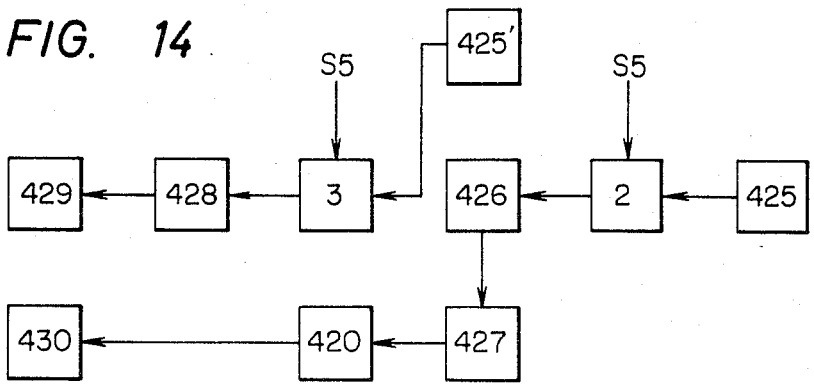
FIGS. 14 and 15 are block diagrams.

FIG. 14 shows the flow chart for that case.

When high-speed recording is to be effected, an image signal S5 imparted to the present apparatus is distributed to the first and second image recording portions 2 and 3 and these two image recording portions 2 and 3 are operated in parallel.

That is, the first image recording portion 2 receives the supply of paper $P_1$ from the first supplying portion 425 and records the image by the signal S5 on one surface of the paper $P_1$, and the paper $P_1$ is directed to the first image fixing means 427 by the path change-over means 426 for the fixation of the image on the paper $P_1$, whereafter the paper $P_1$ is delivered to the paper handling portion 420. In the paper handling portion 420, the solenoids 405 and 413 are rendered inoperative and the received paper $P_1$ is discharged from the carry-out path 443 into the first stacker portion 429. On the other hand, the second image recording portion 3 receives the supply of paper $P_2$ from the second paper supplying portion 425' and records on one surface of the paper $P_2$ the image by the same signal S5 as that used for the paper $P_1$, whereafter the paper $P_2$ passes through the second image fixing means 428 and is discharged into the second stacker portion 430.

Although not shown, conveyor means such as rollers and a belt are disposed in the routes of the paper.

By doing so, if the treating capacities of the first and second image recording portions 2 and 3 per unit time are N sheets, respectively, the treating capacity of the entire apparatus, is 2 N sheets per unit time and thus, double high-speed recording can be realized.

Figure 15:
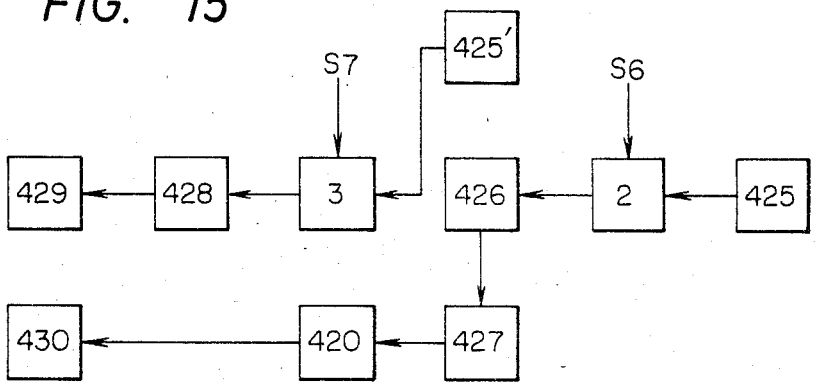

How to cope with the three higher functions has been described above, and in the apparatus of the present embodiment, as shown in the flow chart of FIG. 15, the two image recording portions 2 and 3 can be operated independently of each other by signals S6 and S7 of independent contents and timings with the single apparatus as two recording apparatuses.

That is, the first image recording portion 2 receives the supply of paper $P_1$ from the first supplying portion 425 and records the image by the signal S6 on one surface of the paper $P_1$, and delivers the paper $P_1$ to the paper handling portion 420. In the paper handling portion 420, the solenoids 405 and 413 are rendered inoperative and the received paper $P_1$ is discharged from the carry-out path 443 into the first stacker portion 429. On the other hand, the second image recording portion 3 receives the supply of paper $P_2$ from the second supplying portion 425' and records the image by the signal S7 on one surface of the paper $P_2$, whereafter the paper $P_2$ is discharged into the second stacker portion 430 via the second image fixing means 428.

If so used, the single apparatus can also perform just the same function as two image recording apparatuses each having a treating capacity of N sheets per unit time.

In the present embodiment, a paper supply path 253 of the second image recording portion 3 which is connected to the paper supplying portion 425' and a paper supply path 257 of the second image recording portion 3 which is connected to the paper handling portion 420 are provided discretely, whereas this is not restrictive, but it is also covered by the scope of the present invention that the paper $P_2$ is first directed from the paper supplying portion 425' to the paper handling portion 420 and joins the paper path from the first image recording portion 2 there, whereafter the paper $P_2$ is directed to the second image recording portion 3 or that the paper supplying portion 425' and the paper handling portion 420 are changed over and connected to a supply path.

Figure 16:
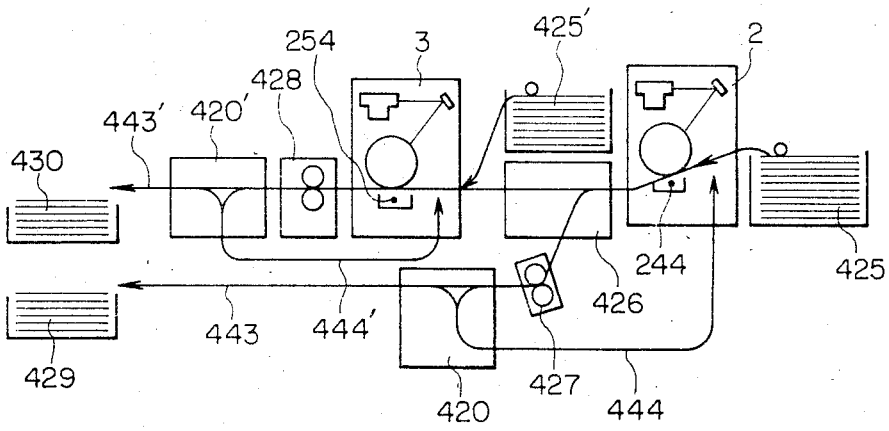
FIGS. 16 and 17 are cross-sectional views showing further embodiments.

FIG. 16 shows another embodiment of the present invention. In FIG. 16, portions functionally similar to those of the second embodiment are given similar reference numerals and need not be described.

In the present embodiment, the first and second image recording portions 2 and 3 respectively have first and second paper supplying portions 425 and 425', first and second image fixing means 427 and 428, and first and second paper handling portions 420 and 420'. Image formation is effected by the first image recording portion 2, and paper having the image thereon fixed by the first image fixing means 427 is reversed in the first paper handling portion 420 in the same manner as that previously described or is not reversed and is directed to a conveyance path 444 and then is delivered to the upstream side of the transfer station 244 of the first image recording portion 2 or is directed to a discharge path 443 and delivered to a first stacker 429. The second paper handling portion 420' is adapted to reverse in the same manner as that previously described the paper having an image formed thereon by the second image recording portion 3 and having the image fixed by the second image fixing means 428 or not reverse the paper and direct the paper to a conveyance path 444' and deliver the paper to the upstream side of the transfer station 254 of the second image recording portion 3 or direct the paper to a discharge path 443' and deliver it to a second stacker 430.

In the present embodiment, during the multiplex recording mode, as in the previous embodiment, images can be formed on the same surface of paper by the first and second image recording portions 2 and 3 without the paper being passed through the first image fixing means 427 and, during the two-side recording mode, an image is formed on a first surface of paper $P_1$ fed from the first paper supplying portion 425, by a first surface image signal, in the first image recording portion 2, and then the paper $P_1$ is delivered to the path change-over means 426, the first image fixing means 427 and the first paper handling portion 420 in the named order, and is reversed in the first paper handling portion 420 and an image is formed on a second surface of the paper by a second surface image signal again in the first image recording portion 2, whereafter the paper is directed to the first image fixing means 427 by the path change-over means 426 for the fixation of the images, and then the paper is directed to the discharge path 443 by the first paper handling portion 420 and is thereby discharged into the first stacker portion 429. On the other hand, likewise in the second image recording portion 3, an image is formed on a first surface of paper $P_2$ fed from the second paper supplying portion 425', by a first surface image signal, and the paper $P_2$ is delivered to the second image fixing means 428 and the second paper handling portion 420' in the named order, and is reversed in the second paper handling portion 420' and directed to a conveyance path 444', whereafter in the second image recording portion 3, an image is formed on a second surface of the paper $P_2$ by a second surface image signal, and then the paper $P_2$ is directed to the second image fixing means 428 for the fixation of the images, whereafter the paper $P_2$ is directed to a discharge path 443' by the second paper handling portion 420' and is thereby discharged into the second stacker 430. From this, it will be seen that since the first and second image recording portions 2 and 3 individually form images, if images are formed on the front and back surfaces of paper by the same image signal, there is provided a two-side double speed mode and that since the two image recording portions, can be controlled by discrete image signals, there are two independent image forming and treating functions during two-side recording. Further, the image formation colors are changed between the first image recording portion and the second image recording portion and after an image is formed also on the second surface of the paper by the first image recording portion 2, the paper is directed to the second image recording portion 3 by the path change-over means 426, and the both-side image formation by the second image recording portion 3, the second image fixing means 428 and the second paper handling portion 420' is effected, whereby multi-colored image formation on both surfaces of the paper becomes possible.

When it is desired to effect one-side double speed mode, after the image formation on the first surface of the paper during the aforedescribed two-side double speed mode, the paper is reversed by the first and second paper handling portions 420 and 420' and is directed not to the conveyance paths 444 and 444' but to the discharge paths 443 and 443', whereby the one-side double speed mode becomes possible.

Figure 17:
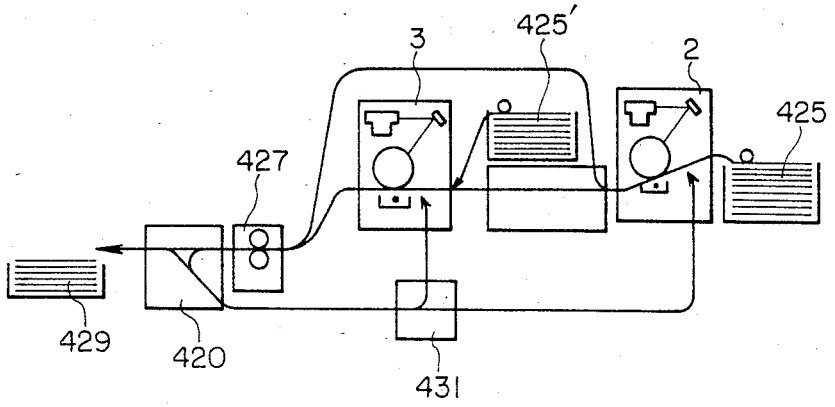

Still another embodiment of the present invention is shown in FIG. 17. In FIG. 17, as in FIG. 16, portions functionally similar to those of the second embodiment are given similar reference numerals and need not be described. The present embodiment adopts a construction in which instead of the first and second image fixing means 427 and 428 and the first and second paper handling portions 420 and 420' of the previously described embodiment, only one of each such means and portions are used in common in the first and second image recording portions 2 and 3. During the double speed mode and the two-side recording mode, the image fixing means 427 and the paper handling portion 420 are designed to provide a speed double or higher than the conveyance speed during the first and second image formations so that there is no hitch in the conveyance of paper on which images have been continuously formed by a single fixing means in the first and second image recording portions. Also, the paper directed from the paper handling portion 420 to the conveyance path is selectively conveyed to one of the first and second image recording portions by path change-over means 431 provided in the intermediate portion of the conveyance path. The present embodiment has an effect similar to that of the previously described embodiment.

Figure 18:
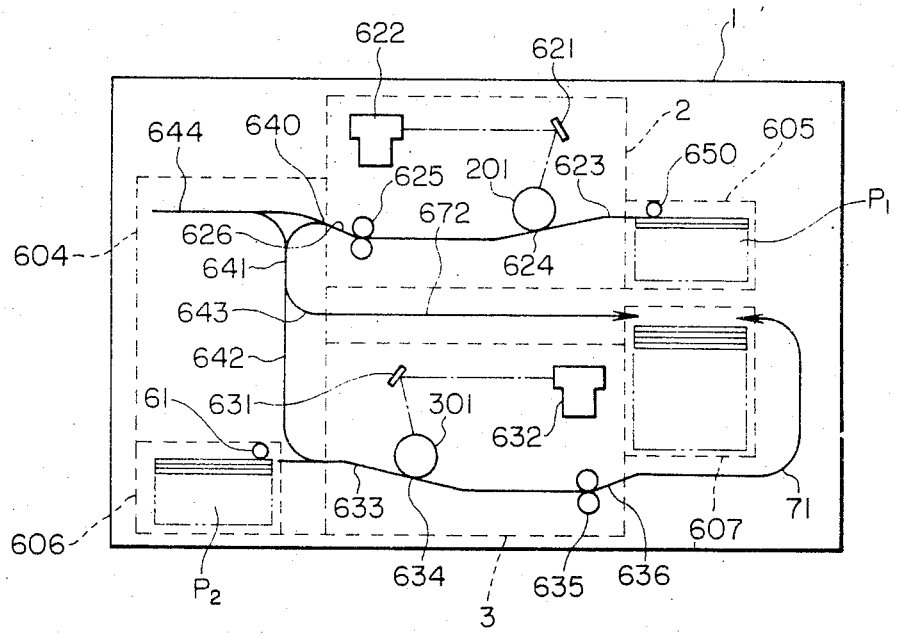
FIG. 18 is a cross-sectional view showing a third embodiment of the present invention.
Figure 19:
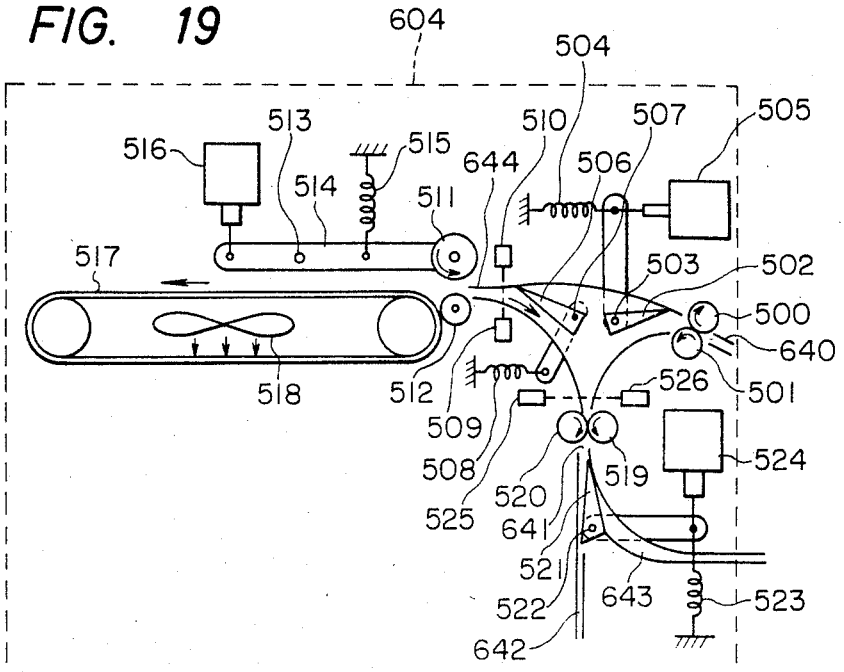
FIG. 19 is a cross-sectional view showing a sheet conveying and handling portion.

A third embodiment of the present invention will now be described in detail by reference to the drawings. FIG. 18 is a cross-sectional view showing the third embodiment of the present invention, and FIG. 19 is a cross-sectional view showing a sheet conveying and handling portion. In FIG. 18, reference numeral 1 designates a main body, the interior of which (contains a first image recording portion 2, a second image recording portion 3, a paper handling portion 604, a first paper feeding portion 605, a second paper feeding portion 606 and a stacker portion 607.

The first and second image recording portions 2 and 3 are laser beam printers similar in construction to each other, but since the direction of paper conveyance differs between these two recording portions, the recording portion 3 is opposite in orientation to the recording portion 2. Describing the first image recording portion 2, reference numeral 201 designates a rotatively driven photosensitive medium around which known electrophotographic process units (not shown) are disposed. A laser beam modulated in accordance with an image signal is scanned on the photosensitive medium 201 by a laser scanner 622 through a mirror 621 to thereby form a latent image on the photosensitive medium, and the latent image is made into a visible image by a predetermined electrophotographic process. On the other hand, sheets of paper $P_1$ piled in the first paper feeding portion 605 are fed into the paper supply path 623 of the first image recording portion 2 one by one by paper feeding means 650 such as a known roller. The paper thus fed comes to a transfer station 624 in synchronism with the visible image on the photosensitive medium 201, and the image is transferred to the paper by known transfer means. The paper then comes to a fixing station, 625, where the image on the paper is fixed by known means such as heating or pressing, whereafter the paper is discharged out of the first image recording portion 2 through a discharge path 626. Although not shown, conveyor means such as rollers and a belt are suitably disposed in the route of the paper.

The paper handling portion 604 will now be described.

The paper handling portion 604 is adapted to reverse the paper received from a carry-in path 640 connected to the discharge path 626, or not to reverse the paper and deliver it from a paper carry-out path 641 to a paper supply path 642 or from a second paper carry-out path 643 to the stacker portion 607.

The details of the interior are shown in FIG. 19. Rollers 500 and 501 in the paper carry-in path 640 are rotatable in the directions of arrows and a path change-over pawl 502 is disposed ahead of these rollers. The path change-over pawl 502 is pivotable about a shaft 503 and is normally biased counter-clockwise as viewed in FIG. 19 by a spring 504 to thereby cause the paper path to face the paper carry-out path 641. When a solenoid 505 is operated, the path change-over pawl 502 rotates clockwise against the force of the spring 504 to thereby change over the path to the paper reversing path 644 side. At the entrance of the paper reversing path 644, a pawl 506 is pivotable about a shaft 507 and is biased clockwise by a spring 508, and paper fed to the left from the carry-in path 640 can pass while pushing aside the upper surface of the pawl 506, and paper returned to the right from the paper reversing portion 644 is guided by the lower surface of the pawl 506 and travels toward the carry-out path 641. A paper detector comprising a lamp 509 and a light-receiving element 510 is provided ajdacent to the pawl 506. Reference numerals 511 and 512 designate a reversing roller and a follower roller, respectively. The reversing roller 511 is mounted on the end of an arm 514 pivotable about a shaft 513 and is normally rotated counter-clockwise as viewed in FIG. 19. The arm 514 is suspended on a spring 515 and the reversing roller 511 usually has an interval with respect to the follower roller 512, but when a solenoid 516 is operated, the arm 514 pivots clockwise and the reversing roller 511 is urged against the follower roller 512. The follower roller 512 is rotatably supported and is rotated clockwise if the reversing roller 511 is urged against the follower roller. A belt 517 movable in the direction of the arrow is provided on the follower roller 512 and paper is conveyed while being attracted to the belt 517 by a fan 518 provided below the belt, and the paper is reliably transported in the direction of the arrow after the conveying force by the rollers 500 and 501 in the paper carry-in path 640 has become null.

The paper fed from the paper carry-in path 640 is reversed or is not reversed and enters the carry-out path 641 with the aid of conveyor rollers 519 and 520, and is conveyed therefrom to the paper supply path 642 or the second paper carry-out path 643 by a pawl 521. The pawl 521 is pivotable about a shaft 522 and is normally biased clockwise by a spring 523 to cause the paper path to face the paper supply path 642. When a solenoid 524 is operated, the pawl 521 rotates counter-clockwise against the force of the spring 523 to thereby change over the path to the second paper carry-out path 643 side. A paper detector comprising a lamp 525 and a light-receiving element 526 is disposed in front of the conveyor rollers 519 and 520, and the solenoid 524 is controlled so as to operate when the leading end edge of the paper intercepts the paper detector and the direction of conveyance of the paper is toward the second paper supply path.

Operation of the paper handling portion 604 will now be described.

The paper having come from the carry-in path 640 is directed to the carry-out path 641 if the solenoid 505 is rendered inoperative, and the paper can be branched off to the paper supply path 642 or to the second paper carry-out path 643 depending on operation of the solenoid 524. On the other hand, if the solenoid 505 is operated, the paper is directed to the reversing portion and the paper having left the reversing portion travels with the so far trailing end edge thereof as the leading end edge. Also, the front and back surfaces of the paper have been changed with each other. Usually, the paper having passed through the reversing portion is conveyed toward the paper supply path 642 with the solenoid 524 rendered inoperative.

In FIG. 18, a second discharge path 672 connected to the second carry-out path 643 and a first discharge path 671 connected to the first carry-out path 636 are provided at opposed positions, and the paper sheets recorded by the first image recording portion 2 and the second image recording portion 3 are piled in the stacker 607 with the image bearing surface thereof facing downward.

How to cope with the previously described high-speed recording, two-side recording and multiplex recording by the apparatus as described above will hereinafter be described.

I. High-Speed Recording

Figure 20:
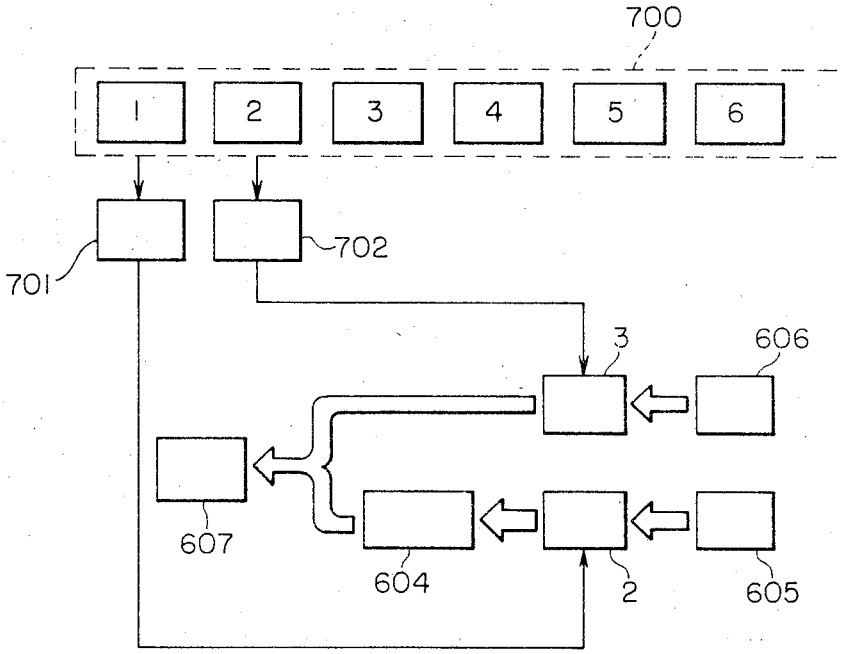
FIG. 20 is a block diagram in the case of high-speed recording.

When high-speed recording is to be effected, the page data information imparted to the apparatus is distributed to the first and second image recording portions 2 and 3, and these two image recording portions, including the paper feeding portions, are operated at one time and output paper sheets are superposed one upon another in the stacker portion (FIG. 20).

Figure 21:
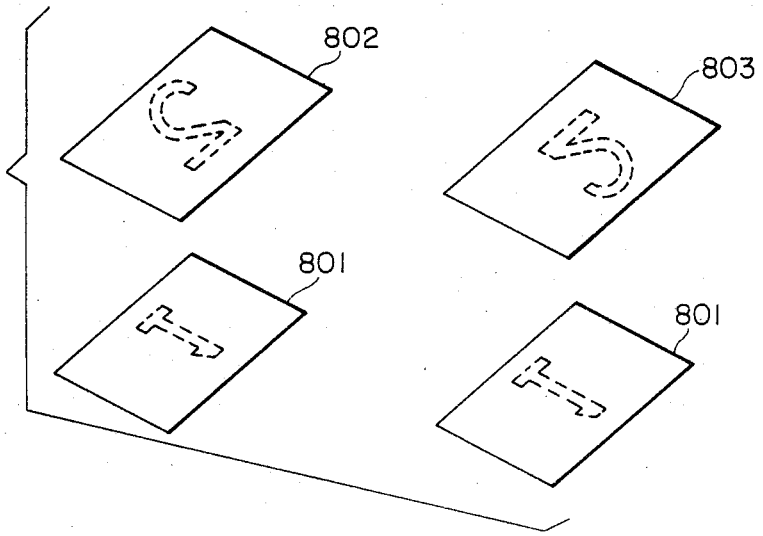
FIG. 21 show the reversed state of sheets.

That is, data information 700 comprising a series of page data trains is distributed to output memories 701 and 702 corresponding to the first and second image recording portions in such a manner that odd page information is stored in the output memory 701 and even page information is stored in the output memory 702. In the first image recording portion 2, the supply of paper $P_1$ is received from the first paper feeding portion 605 and the page data of the output memory 701 is recorded on one surface of the paper $P_1$, which is then delivered to the paper handling portion 604. In the paper handling portion 604, the solenoid 505 is rendered inoperative and the solenoid 524 is operated and the received paper $P_1$ is discharged from the carryout path 643 through the first discharge path 671 into the stacker 607. On the other hand, the second image recording portion 3 receives the supply of paper $P_2$ from the second paper feeding portion 606 and records the page data of the output memory 702 on one surface of the paper $P_2$, which is then discharged into the stacker 607 through the second discharge path 672. It should be noted here that, as shown in FIG. 21, the direction 801 of the image output from the first image recording portion and the direction 802 of the image output from the second image recording portion are opposite to each other. To avoid such situation, if printing is carried out with the direction of the output image being turned by 180° as indicated by 803, the same direction of the image as the direction 801 will be provided. Alternatively, the image 801 may be turned by 180° with the image 802 remaining unchanged.

Figure 22:
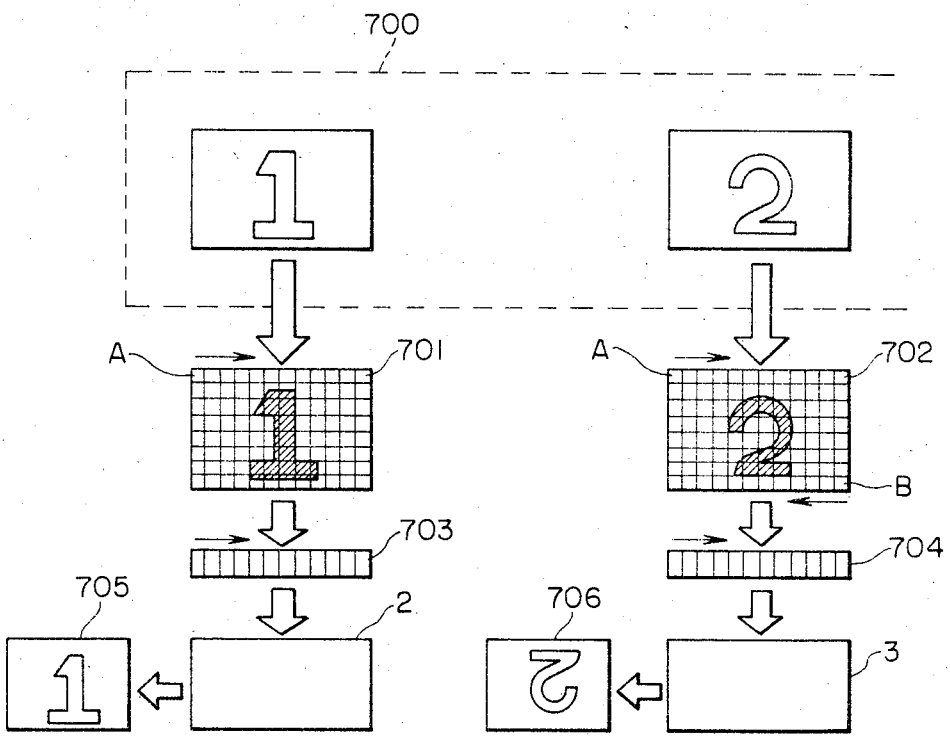
FIG. 22 shows data processing.

FIG. 22 shows the data processing for the turn by 180°. When the data successively transferred from the page data train 700 to the page memory 702 in the rightward direction of the arrow from the top address A are output to a line buffer 704, reverse reading in the leftward direction of the arrow is effected from the rear end address B on the page memory 702. The data formed on the line buffer 704 are output in the rightward direction of the arrow and an image is recorded on the paper by the second image recording portion 3 and thus, there is obtained the output of an inverted image 706. On the other hand, showing a case where the image is not inverted, when the data successively transferred from the page data train 700 to the page memory 701 in the rightward direction of arrow from the top address A are output to a line buffer 703, forward reading is effected in the rightward direction of arrow from the top address A. The data formed on the line buffer 703 are output in the rightward direction of the arrow and an image is recorded on the paper by the first image recording portion 2 and thus, there is obtained an erect image 705.

II. Multiplex Recording

Figure 23:
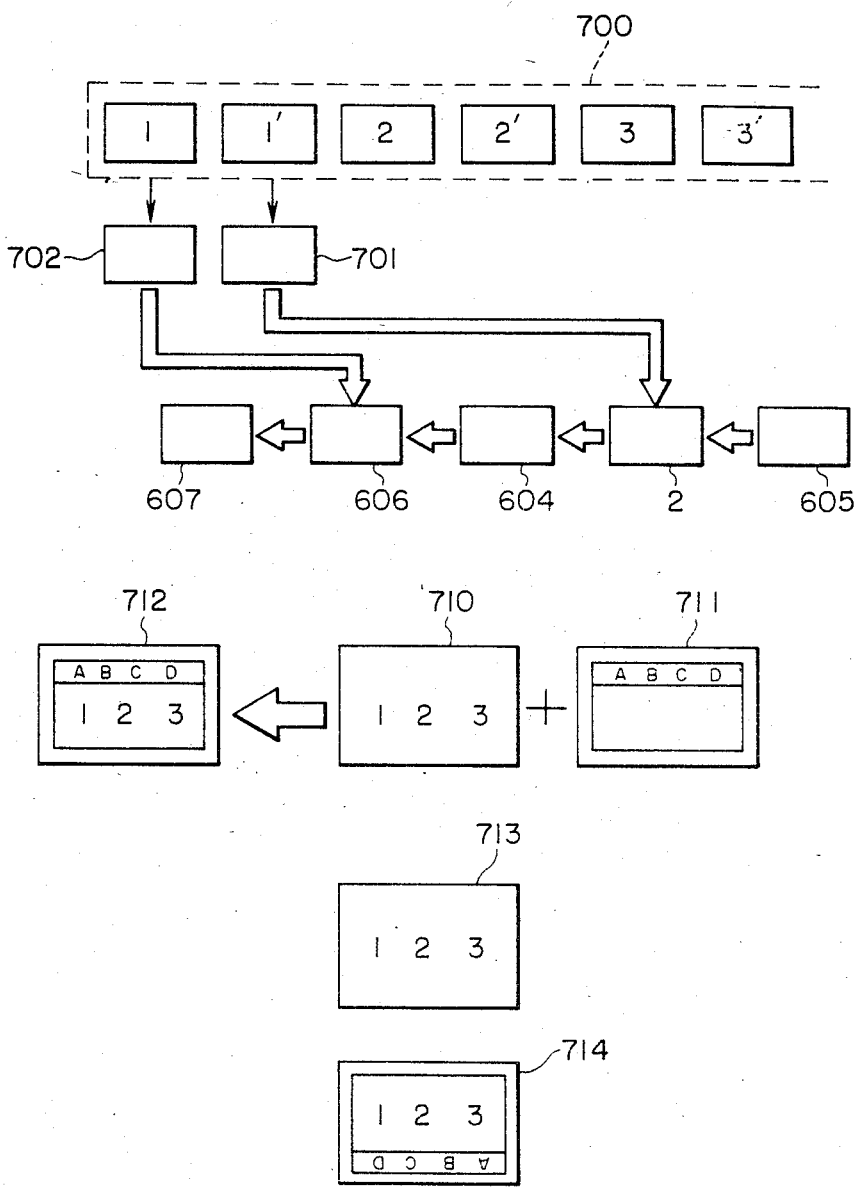
FIG. 23 is a block diagram showing the case of multiplex recording.

When multiplex recording is to be effected, as shown in FIG. 23, first recording information of the multiplex recording is distributed to the first image recording portion and second recording information is distributed to the second image recording portion, and recorded images are superposed on the same paper. That is, data information 700 comprising a series of page data trains is distributed to the output memories 701 and 702 corresponding to the first and second image recording portions in such a manner that, for example, the first recording information is stored in the output memory 701 and the second recording information is stored in the output memory 702. The first image recording portion 2 receives the supply of paper $P_1$ from the first paper feeding portion 605, records the page data of the output memory 701 on one surface of the paper $P_1$ and delivers the paper $P_1$ to the paper handling portion 604. In the paper handling portion 604, the solenoid 505 is operated and the paper is directed to the paper reversing portion, and the paper after being reversed is conveyed toward the paper supply path 642 with the solenoid 524 rendered inoperative. In the paper reversing portion, not only the front and back surfaces but also the leading and trailing end edges of the paper change places with each other. In FIG. 23, there is data shown at 710 as the first recording information and there is data shown at 711 as the second recording information and, as a result of multiplex recording, these data become data shown at 712. Assuming that the image recorded on the paper by the first image recording portion is 713, if the data shown at 711 in the second image recording portion is directly superposed on the paper passed through the paper handling portion, the data 711 will become inverted as shown at 714. To avoid such situation, if the image is output to the second image recording portion while being turned by 180° as shown in FIG. 22, it will be apparent that there is obtained the image indicated at 712. Of course, the image may be turned by 180° in the first image recording portion and the image may be intact output in the second image recording portion.

III. Two-Side Recording

Figure 24:
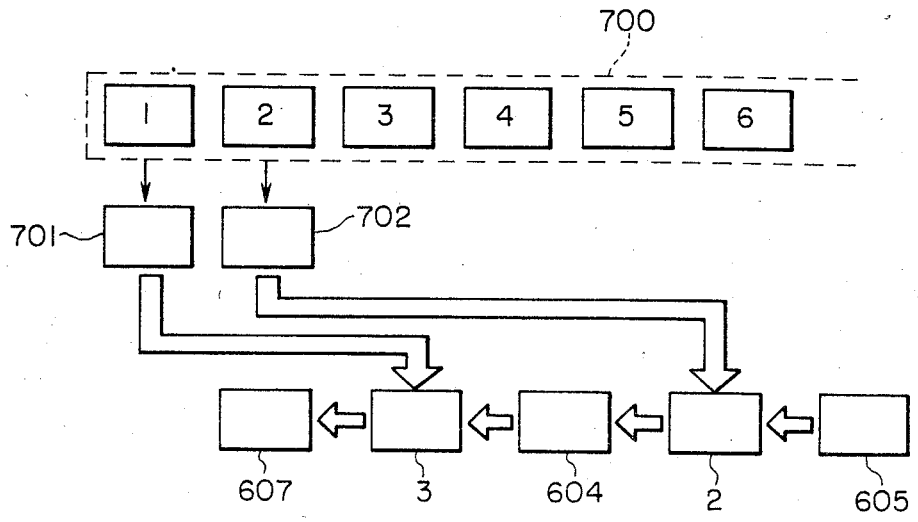
FIG. 24 is a block diagram showing the case of two-side recording.

When two-side recording is to be effected, as shown in FIG. 24, first recording information to be recorded on one surface of paper is distributed to the first image recording portion and second recording information to be recorded on the opposite surface of the paper is distributed to the second image recording portion, whereby recorded images are made on the front and back surfaces of the same paper.

That is, data information 700 comprising a series of page data trains is distributed to the output memories 702 and 701 corresponding to the first and second image recording portions in such a manner that, for example, odd page data are stored in the output memory 701 and even page data are stored in the output memory 702. The first image recording portion 2 receives the supply of paper $P_1$ from the first paper feeding portion 5, records the even page data of the output memory 702 on one surface of the paper $P_1$ and delivers the paper to the paper handling portion 604. In the paper handling portion 604, the solenoids 505 and 524 are rendered inoperative and the paper fed from the paper carry-in path 640 is transported to the paper supply path 642. In the second image recording portion, the odd page data of the output memory 701 is recorded on the back surface of the paper $P_1$, which is then transported to the stacker 607. Thus, paper sheets become piled in the stacker 607 with the odd pages thereof facing downward.

Figure 25:
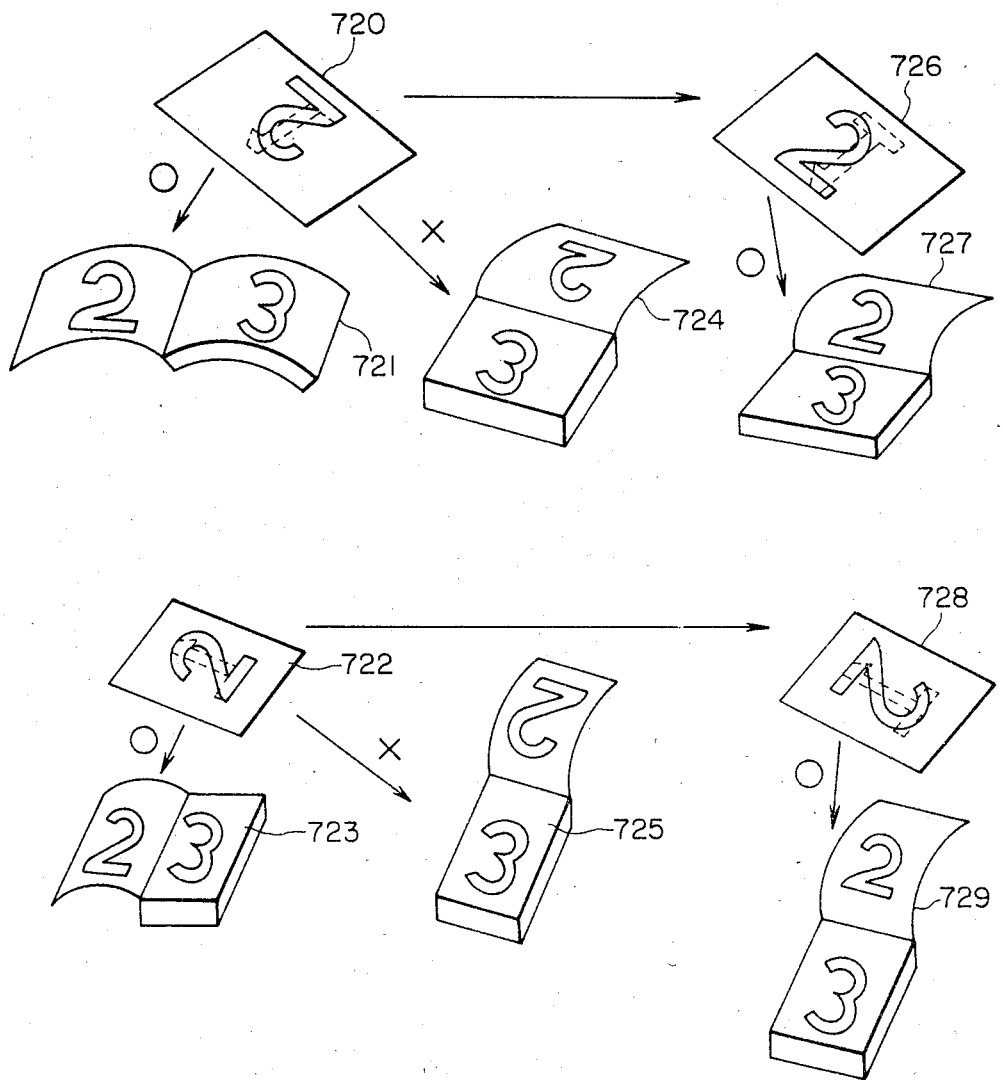
FIG. 25 shows the reversed state of sheets.

Now, in the foregoing description of high-speed recording and multiplex recording, it has been made clear that in the first and second image recording portions, it is necessary to effect recording with the relation of erect image and inverted image from the viewpoint of image output. In the case of two-side recording, there occurs another problem as to erect image and inverted image, and this will be described by reference to FIG. 25. When outputting is effected in the same image direction in the first and second image recording portions, in the lateral feeding wherein the lengthwise direction of paper $P_1$ is lateral with respect to the direction of conveyance and the longitudinal feeding wherein the lengthwise direction of paper $P_1$ is longitudinal with respect to the direction of conveyance, there are obtained the outputs shown at laterally fed output paper 720 and longitudinally fed output paper 722 and when these are bound, it is usual to make them into the forms of a laterally bound file 721 and a longitudinally bound file 723, respectively. However, if an attempt is made to make the laterally fed output paper 720 into longitudinally a bound file 724, the image on one surface becomes inverted when the file is opened. Likewise, if an attempt is made to make the longitudinally fed output paper 722 into a laterally bound file 725, the image on one surface becomes inverted when the file is opened. To avoid such a situation, if, for example, outputting is effected with the even page data output from the first image recording portion being turned by 180°, there are obtained laterally fed output paper 726 and longitudinally fed output paper 728, and longitudinally bound file 727 is obtained with the laterally fed output paper 726 bound longitudinally and laterally bound file 729 is obtained with the longitudinally fed output paper 728 bound laterally. Generally, the output file is often made into the form of longitudinally bound file 724 or 727. To enable the longitudinal binding, whether the direction of feeding of the paper is longitudinal or lateral may be discriminated and whether outputting should be effected, for example, with the image being made into an erect image or an inverted image in the second image recording portion may be controlled. That is, when longitudinal feeding is detected, control is effected so that the directions of output images are the same direction between the first and second image recording portions. When lateral feeding is detected, control is effected so that the directions of output images are opposite to each other between the first and second image recording portions. Where lateral binding is required, for example, a switch is provided in the present image recording apparatus and control is effected so that during operation of this switch, the lateral binding mode is provided. That is, in the lateral binding mode, when longitudinal feeding is detected, control is effected so that the directions of output images are opposite to each other between the first and second image recording portions. When lateral feeding is detected, control is effected so that the directions of output images are the same direction between the first and second image recording portions.

IV. Independent Recording

Figure 26:
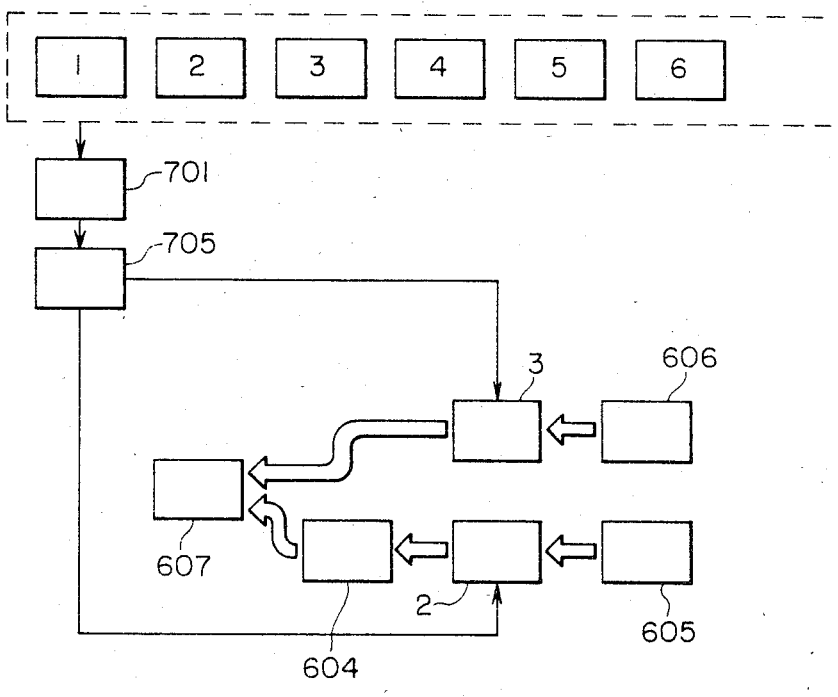
FIG. 26 is a block diagram showing the case of independent recording.

When independent recording is to be effected, the page data information imparted to the present apparatus is distributed to the first or the second image recording portion as shown in FIG. 26 and outputting is effected.

That is, data information 700 comprising a series of page data trains is transferred to the output memory 701 and an output data is imparted to the first or the second image recording portion by a distributor 705. When the output data is imparted to the first image recording portion, this image recording portion receives the supply of paper $P_1$ from the first paper feeding portion 605, records the page data of the output memory 701 on one surface of the paper $P_1$ and delivers the paper $P_1$ to the paper handling portion 604. In the paper handling portion 604, the solenoid 505 is rendered inoperative and the solenoid 524 is operated and the received paper $P_1$ is discharged from the carry-out path 643 through the first discharge path 671 into the stacker 607. When the output data is imparted to the second image recording portion, this image recording portion receives the supply of paper $P_2$ from the second paper feeding portion 606 and records the page data of the output memory 702 on one surface of the paper $P_2$, which is then discharged into the stacker 607 through the second discharge path 672. As is apparent from what has so far been described, it is necessary that the images when output to the first and second image recording portions be turned by 180° in order that the direction of the image output by the first image recording portion may be coincident with the direction of the image output by the second image recording portion. In the following case, however, the directions of the images need not always be turned, by 180° but the images may be output intact. That is, if the first and second image recording portions are alternately used as the object of outputting per job unit or per file unit comprised of a plurality of page data, the directions of the output images will change per job unit or per file unit and thus, the division of the job unit or the file unit can be made clear.

Figure 27:
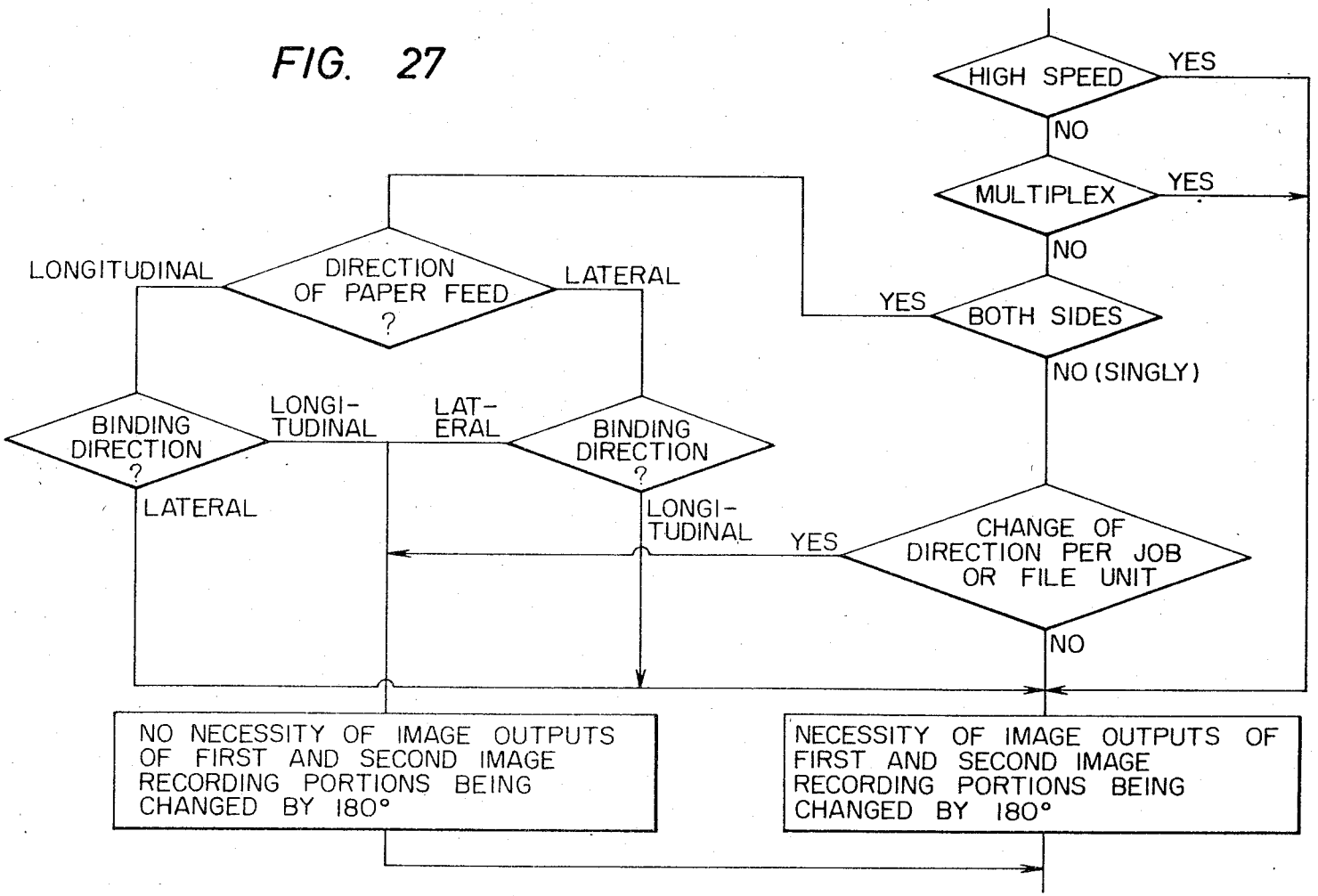
FIG. 27 is a flow chart.

In the case of high-speed recording, multiplex recording, two-side recording and independently recording, a case where the image output need be turned by 180° relative to the first and second image recording portions and a case where the image output need not be turned by 180° relative to the first and second image recording portions are shown in the flow chart of FIG. 27. High-speed recording and multiplex recording must be effected with the image output turned by 180°. In the case of two-side recording the selection of whether the image output should be turned by 180° or not changes depending on the selection of the direction of paper feeding and the binding direction. Again in the case of independent recording, it has become apparent that processing changes depending on whether the direction of the image is changed per job or file unit.

Figure 28:
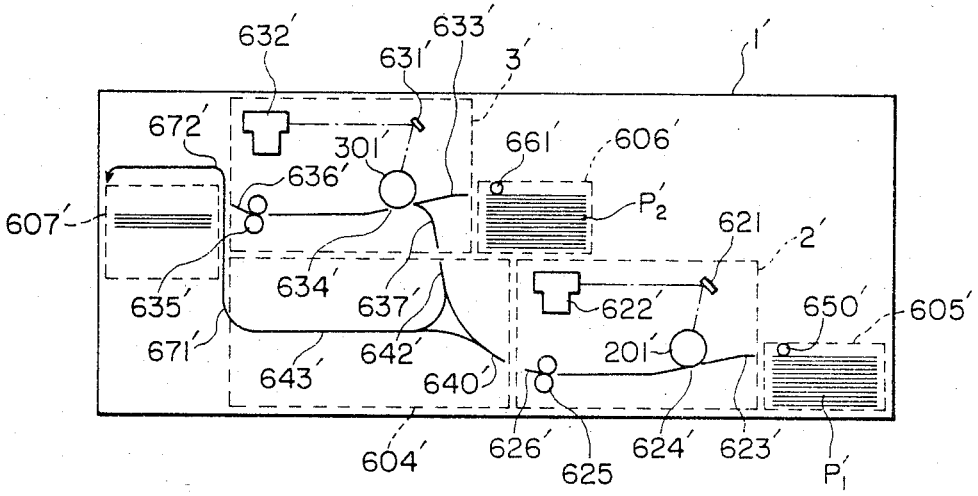
FIG. 28 is a cross-sectional view showing another embodiment.

FIG. 28 is a cross-sectional view showing another conveyance path construction of the present invention, and an example in which conveyance paths are constructed between the first and second image recording portions will hereinafter be described. In FIG. 28, unlike the case of FIG. 18, unless the surface on which an image has been formed by the first image recording portion 2' is reversed in the paper handling portion 604', it becomes possible in the second image recording portion 3' to form an image on the same surface and conversely, for two-side recording, it is necessary to reverse the paper without fail and feed it to the second image recording portion 3'. For convenience of description, portions functionally similar to those of FIG. 18 are given similar reference numerals with a prime affixed thereto and need not be described. However, some differences are found in that the first discharge path 671' connected to the stacker 607' and the second discharge path 672' join each other on the way, and in the conveyance route of the paper handling portion 604'.

Figure 29:
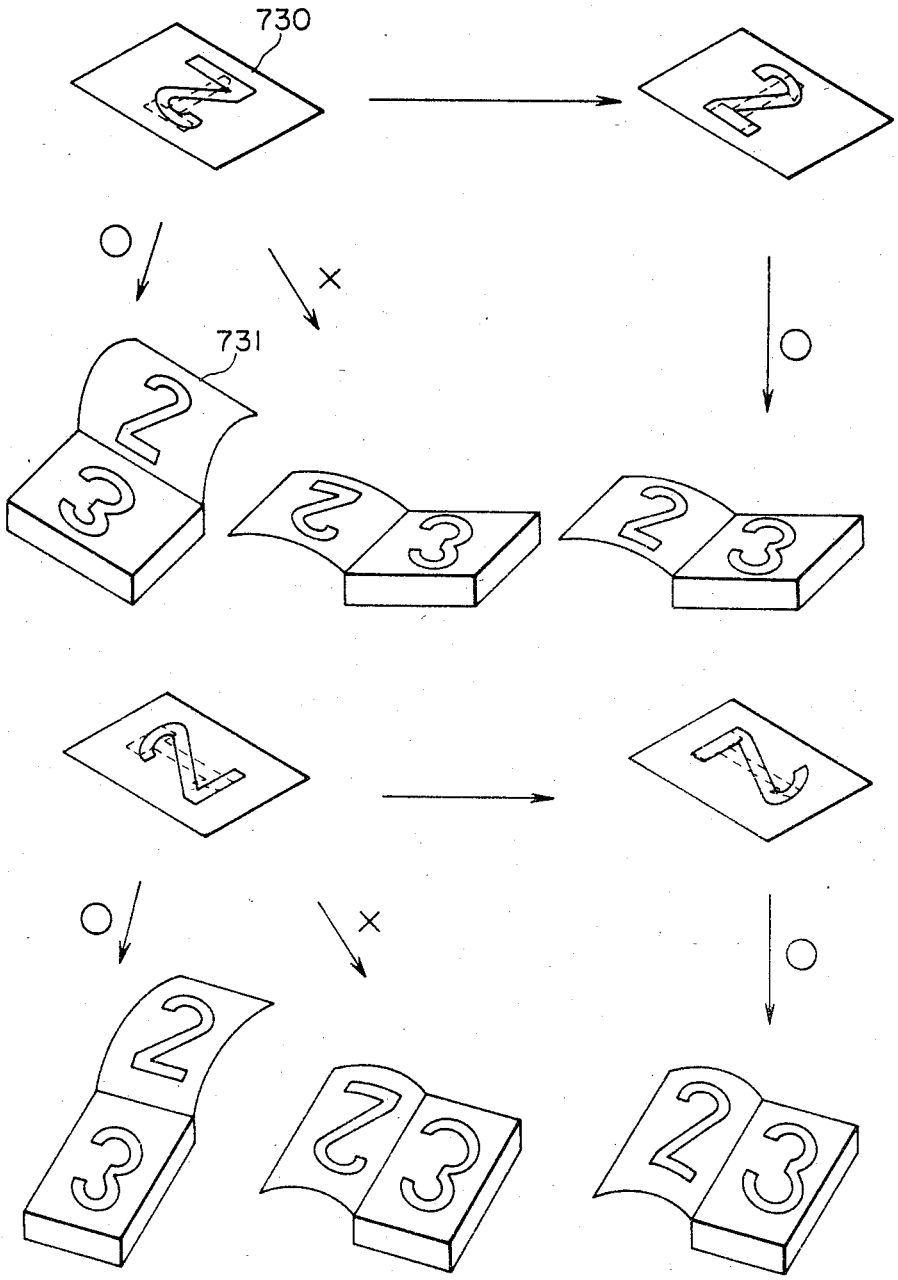
FIG. 29 shows the reversed state of sheets.

In the case of FIG. 28, the direction of paper does not differ between high-speed recording and multiplex recording and therefore, the directions of the images recorded by the first and second image recording portions 2' and 3' may be identical to each other. Also, in independent recording, the directions of the images recorded may be identical to each other unless the directions of the images are changed per job unit or file unit. Now, in the case of two-side recording, similarly to the problem shown in FIG. 25, the image outputting method changes depending on the relation between the direction of paper feeding and the binding direction. In FIG. 29, if, conversely to the case of FIG. 25, the laterally fed paper is longitudinally bound or the longitudinally fed paper is laterally bound, the directions of the outputs in the first and second image recording portions 2' and 3' may be identical to each other. If the laterally fed paper is laterally bound or the longitudinally fed paper is longitudinally bound, it is necessary that the directions of the outputs in the first and second recording portions 2' and 3' be turned by 180°.

Figure 30:
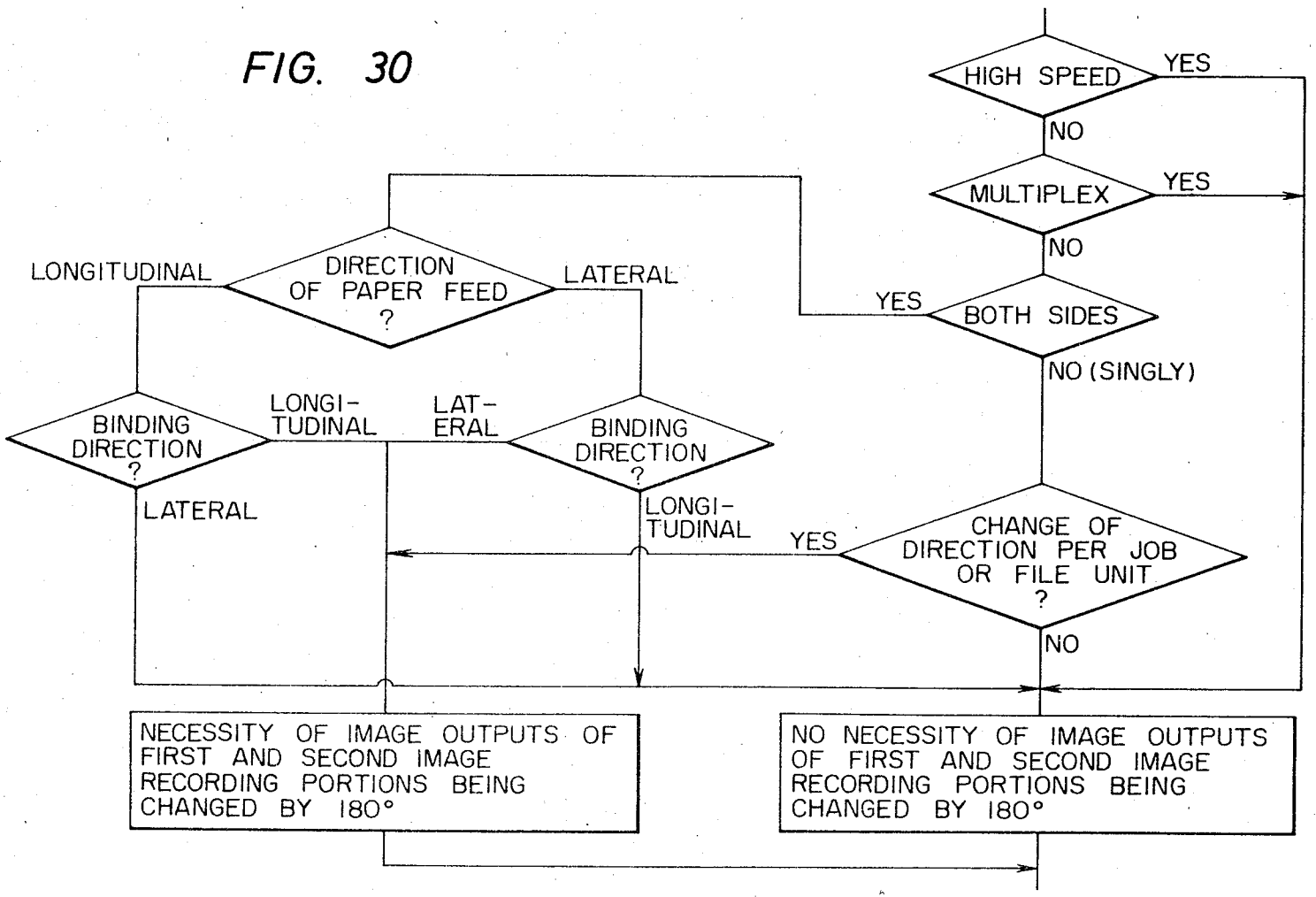
FIG. 30 is a flow chart.

FIG. 30 is converse to FIG. 27, and in high-speed recording and multiplex recording, it is not necessary to turn the image output by 180° . In the case of two-side recording, whether the image output should be turned by 180° is selected depending on the selection of the direction of paper feeding and the binding direction. Also in the case of independent recording, it is necessary to turn the image output by 180° only when it is desired to change the directions of the images per job or file unit.

As described above, in the construction of FIG. 18 and the construction of FIG. 28, it has become clear that in all of the recording forms including high-speed recording, multiplex recording, two-side recording and independent recording, to obtain the same image output for the first and second image recording portions, the turning of the image by 180° is necessary in the example of FIG. 28 if it is unnecessary in the example of FIG. 18 or the turning of the image by 180° is unnecessary in the example of FIG. 28 if it is necessary in the example of FIG. 18.

In addition to the above-described modifications, description has been made of an example in which the page memory is reversely read, for example, when the turning of the image by 180° is read into the line buffer in the example of FIG. 22, but alternatively, the turning of the image by 180° may be effected by the use of another page memory or a data in which the input data itself has been turned by 180° in advance may be made. In this case, the image recording portions may be informed of whether the data has been turned by 180° and it may be controlled whether the turning by 180° on the side of the image recording portions should be effected.

As a further alternative, design may be made such that during two-side recording, the direction of paper feeding and the binding direction are recorded in the input data in advance and a command of the presence of the turning of the image by 180° is produced by said recording. It will be apparent that which of odd pages or even pages should be output earlier to the first and second image recording portions during both-side recording is determined by the construction of the conveying system.

Also, whether the turning of the image by 180° is necessary or not for the first and second image recording portions depending on the image recording mode, it is free to determine whether an output in which the image has been turned should be put out to the first recording portion.

Also, it has been described that during independent recording, the direction of the image is changed per job unit or file unit, whereas this is not limited to independent recording, but apparently it is also possible in any recording mode such as high-speed recording, multiplex recording or two-side recording.

While the image recording means has been described with a laser beam printer taken as an example, the present invention can be of course carried out in other means, for example, dot type printers such as ink jet, heat transfer and wire dot printers.

As described above in detail, each of the embodiments of the present invention has the following excellent effects:

1. By providing a plurality of image recording portions, high-speed operation of the apparatus can be easily realized without causing the various evils which are experienced when a single apparatus is made into a high-speed one. Accordingly, an image recording apparatus having a speed exceeding the upper limit by the system which has heretofore been considered can be obtained stably and economically.

2. Also, by connecting two image recording portions by a paper handling portion, the apparatus can be used not only as a high-speed recording apparatus but also as a two-side recording apparatus. During two-side recording, it does not happen that as in the prior art, unless the recording on a first surface is completed, the recording on a second surface cannot be started, but the recording on the second surface can be effected in the second image recording portion while the recording on the first surface is effected in the first image recording portion and thus, very efficient recording can be accomplished.

3. Further, multiplex recording is continuously possible with just the same apparatus and a variety of image recordings including color recording can be accomplished.

4. A single apparatus can be used just in the same way as two other recording apparatuses.

5. By providing a single paper feeding portion and a single stacker portion (sorter portion) in spite of a plurality of image recording portions being provided, the convenience of operation of the operator can be achieved.

6. Even when two-side recording is to be effected, there is no paper reversing process, and this leads to the possibility of appreciably enhancing the reliability.

7. During the multiplex recording mode, the image position accuracy can be enhanced by eliminating means such as image fixing means exerting a stress on paper between the first image recording portion and the second image recording portion and thus, beautiful images free of image misregistration can be obtained.

8. When paper handling such as the reversal of paper during two-side recording is to be effected, such paper handling takes place after image fixation is effected, whereby beautiful two-side images can be obtained without the image on the first surface being injured.

9. By connecting a plurality of image recording portions by a paper handling portion and combining them with means for enabling the image data to be freely turned by 180° to assume various recording modes such as high-speed recording, multiplex recording, two-side recording and independent recording, it has become possible that the direction of the image on the output image is properly output on paper.

10. Particularly, during two-side recording, whether the image output should be turned by 180° can be controlled by the information of the direction of paper feeding and the binding direction and therefore, when output paper sheets are made into a file, it has become possible to eliminate the inconvenience that the output images on the two opened pages are erect and inverted.

11. It is also possible to change the direction of the image per job unit or file unit and thus, it has also become possible to judge the output sections piled in the stacker portion by the erectness or inversion of the images.

In the present embodiment, the image forming means has been described as a laser beam printer using the electrophotographic method or the ink jet method, whereas this is not restrictive but all other recording systems such as the impact method and the non-impact method are of course applicable.

What is claimed is:

1. A multi-function image recording apparatus for recording images on a sheet, said apparatus comprising:

a first image recording device having a first sheet supply path for supplying a sheet, a first image forming portion for forming images on the sheet supplied from said first sheet supply path, and a first sheet discharge path for discharging the sheet from said first image forming portion;

a second image recording device having a second sheet supply path connected to said first sheet discharge path for supplying the sheet, a first-side image forming portion for forming an image on the first side of the sheet supplied through said second sheet supply path, and a second-side image forming portion for forming an image on the second side of said sheet;

a first conveyance path extending from said second sheet supply path through said first side image forming portion;

a second conveyance path extending from said second sheet supply path through said second-side image forming Portion; and path change-over means for guiding the sheet to either one of said first conveyance path and said second conveyance path.

2. A multi-function image recording apparatus for recording images on sheets, said apparatus comprising:

first and second image recording devices each at least having a supply path for supplying sheets, an image forming portion for forming images on the sheets supplied from said supply path, and a discharge path for discharging the sheets from said image forming portion;

a conveyance path for conveying sheets from said first image recording device;

first image fixing means for fixing the images recorded on the sheets by said first image recording device; and path change-over means provided on said conveyance path for conveying the sheets having images formed thereon by said first image recording device, said path change-over means directing said sheets selectively to one of said second image recording device and said first image fixing means.

3. A multi-function image recording apparatus for recording images on sheets, said apparatus comprising:

first and second image recording devices each at least having a supply path for supplying sheets, an image forming portion for forming images on the sheets supplied from said path, and a discharge path for discharging the sheets from said image forming portion;

a sheet handling device having a sheet carry-in path connected to the discharge path of said first image recording device, a first sheet carry-out path connected to said supply path of said second image recording apparatus, a second sheet carry-out path for discharging the sheets out of the apparatus, and change-over guide means for selectively directing the sheets carried on said carry-in path to either one of said first sheet carry-out path and said second sheet carry-out path; and means for selecting the direction of the image output to said first image recording apparatus relative to the direction of the image output to said second image recording apparatus between one of the same direction and a direction turned by 180°.

4. A multi-function image recording apparatus for forming images on a sheet, said apparatus comprising:

first and second image recording devices, each having a supply path for supplying a sheet, an image forming portion for forming an image on the sheet supplied through said path, and a discharge path for discharging the sheet from said image forming portion;

image fixing means for fixing an image recorded on the sheet by at least one of said first image recording device and said second image recording device;

path change-over means provided on a conveyance path for conveying a sheet having an image formed thereon by said first image recording device and discharged therefrom through said discharge path of said first image recording device, said path change-over means directing said sheet selectively to one of said second image recording device and said image fixing means;

a sheet handling means;

switching means for selectively directing a sheet to one of said first and second image recording devices; and a final discharge path for discharging a sheet from said apparatus;

said sheet handling means selectively directing a sheet passed through said image fixing means to one of said final discharge means and said switching means.

5. A multi-function image recording apparatus according to claim 1, further comprising a third conveyance path which passes through neither of said first-side image forming portion or said second-side image forming portion.

6. A multi-function image recording apparatus according to claim 1, wherein said second image recording device includes a single image bearing member operable in cooperation with said first-side image forming portion and said second-side image forming portion and means for rotating said image bearing member in opposite directions when it cooperates respectively with said first-side image forming member and said second-side image forming member.

7. A multi-function image recording apparatus according to claim 5, wherein said second image recording device includes another path change-over means for directing the sheets to one of said first, second and third conveyance paths.

8. A multi-function image recording apparatus according to claim 2, further having a first discharge path for discharging sheets out of said apparatus, and sheet handling means for selectively directing the sheets passed through said first image fixing means to one of said second image recording device and said first discharge path.

9. A multi-function image recording apparatus according to claim 8, wherein said sheet handling means includes a sheet reversing portion for reversing the sheets.

10. A multi-function image recording apparatus according to claim 2, further having a first discharge path for discharging sheets out of said apparatus, and first sheet handling means for selectively directing the sheets passed through said first image fixing means to one of said first image recording apparatus and said first discharge path.

11. A multi-function image recording apparatus according to claim 10, wherein said first sheet handling means includes a sheet reversing portion.

12. A multi-function image recording apparatus according to claim 10, further having a second discharge path for discharging sheets out of said apparatus, a second image fixing means for fixing the images recorded on the sheets by said second image recording device, and second sheet handling means for selectively directing the sheets passed through said second image fixing means to one of said second image recording device and said second discharge path.

13. A multi-function image recording apparatus according to claim 2, wherein said first image fixing means is used in common for said first and second image recording devices.

14. A multi-function image recording apparatus according to claim 3, wherein said sheet handling device includes a sheet reversing portion for reversing the sheets.

15. A multi-function image recording apparatus according to claim 3, wherein said first image recording device and said second image recording device record the same image on discrete sheets in accordance with a single image signal.

16. A multi-function image recording apparatus according to claim 3, wherein said first image recording device and said second image recording device operate in synchronism with each other and record respective images on both surfaces of the sheets.

17. A multi-function image recording apparatus according to claim 3, wherein said first image recording device and said second image recording device operate in synchronism with each other and record respective images on the same surface of the sheets in superposed relationship.

* * * * *

UNITED STATES PATENT AND TRADEMARK OFFICE

CERTIFICATE OF CORRECTION

PATENT NO. : 4,591,884

DATED : May 27, 1986

INVENTOR(S) : KOICHI MIYAMOTO, ET AL.

It is certified that error appears in the above-identified patent and that said Letters Patent is hereby corrected as shown below:

COLUMN 2

Lines 29-30, "larges-/caled" should read --large-scaled--.

COLUMN 3

Line 5, "record" should read --second--.
Line 13, "in" should read --comprises--.

COLUMN 4

Line 7, "block diagrams" should read --flow charts--.
Line 10, "double speed" should read --double-speed--.
Line 11, "block diagrams." should read --flow charts.--.
Line 20, "show" should read --shows--.
Line 54, "202.a" should read --202, a--.

COLUMN 5

Line 9, "counter-clockwise" should read --counterclockwise--.

COLUMN 6

Line 23, "path into" should read --path 317 into--.
Line 24, "portion." should read --portion 6.--.
Line 52, "counter-clockwise" should read --counterclockwise--.
Line 52, "was" should read --as--.

UNITED STATES PATENT AND TRADEMARK OFFICE

CERTIFICATE OF CORRECTION

PATENT NO. : 4,591,884

DATED : May 27, 1986

INVENTOR(S) : KOICHI MIYAMOTO, ET AL.

It is certified that error appears in the above-identified patent and that said Letters Patent is hereby corrected as shown below:

COLUMN 8

Line 9, "a image" should read --an image--.
Line 42, "durinq" should read --during--.
Line 54, "then" should read --them--.

COLUMN 9

Line 45, "counter-clockwise" should read --counterclockwise--.

COLUMN 11

Line 56, "counter-clockwise" should read --counterclockwise--.

COLUMN 12

Line 7, "counter-clockwise" should read --counterclockwise--.
Line 37, "counter-clockwise" should read --counterclockwise--.
Line 47, "channeled directed" should read --directly channeled--.

COLUMN 13

Lines 21-22, "complet-/ing, two-side" should read --completing two-side--.
Lines 55-56, "double speed" should read --double-speed--.

UNITED STATES PATENT AND TRADEMARK OFFICE

CERTIFICATE OF CORRECTION

PATENT NO. : 4,591,884

DATED : May 27, 1986

INVENTOR(S) : KOICHI MIYAMOTO, ET AL.

It is certified that error appears in the above-identified patent and that said Letters Patent is hereby corrected as shown below:

COLUMN 13

Line 64, "double speed" should read --double-speed--.

COLUMN 16

Line 2, "portions, can" should read --portions can--.
Line 11, "both-side" should read --two-side--.
Line 35, "double speed" should read --double-speed--.
Line 56, "which (contains" should read --which contains--.

COLUMN 17

Line 15, "station, 625," should read --station 625,--.
Line 35, "counter-clockwise" should read --counterclockwise--.
Line 55, "counter-clockwise" should read --counterclockwise--.

COLUMN 18

Line 11, "counter-clockwise" should read --counterclockwise--.

COLUMN 19

Line 3, "carryout" should read --carry-out--.

COLUMN 20

Line 16, "intact output" should read --output intact--.

UNITED STATES PATENT AND TRADEMARK OFFICE

CERTIFICATE OF CORRECTION

PATENT NO. : 4,591,884

DATED : May 27, 1986

INVENTOR(S) : KOICHI MIYAMOTO, ET AL.

It is certified that error appears in the above-identified patent and that said Letters Patent is hereby corrected as shown below:

COLUMN 20

Lines 66-67, "longitudi-/nally a" should read --a longitudinally--.

COLUMN 22

Line 12, "independently" should read --independent--.
Line 20, "recording the" should read --recording, the--.

COLUMN 24

Line 1, "by" should read --of--.

COLUMN 25

Line 18, "first side" should read --first-side--.
Line 22, "Portion;" should read --portion;--.

Signed and Sealed this

Twenty-fourth Day of November, 1987

*Attest:*

DONALD J. QUIGG

*Attesting Officer*

*Commissioner of Patents and Trademarks*